US011795595B2

(12) United States Patent
Baggen et al.

(10) Patent No.: US 11,795,595 B2
(45) Date of Patent: Oct. 24, 2023

(54) MANUFACTURING FRAME

(71) Applicant: NIKE, Inc., Beaverton, OR (US)

(72) Inventors: Jared S. Baggen, Portland, OR (US); Bruce Alan Barney, Portland, OR (US); Daniel B. DeHaven, Sherwood, OR (US); Bruce J. Kilgore, Lake Oswego, OR (US); John Joseph Terlizzi, Austin, TX (US)

(73) Assignee: NIKE, Inc., Beaverton, OR (US)

( * ) Notice: Subject to any disclaimer, the term of this patent is extended or adjusted under 35 U.S.C. 154(b) by 961 days.

(21) Appl. No.: 16/168,364

(22) Filed: Oct. 23, 2018

(65) Prior Publication Data

US 2019/0119843 A1 Apr. 25, 2019

Related U.S. Application Data

(60) Provisional application No. 62/576,600, filed on Oct. 24, 2017.

(51) Int. Cl.
*D06C 3/08* (2006.01)
*A43D 8/00* (2006.01)
(Continued)

(52) U.S. Cl.
CPC ..... *D06C 3/08* (2013.01); *A43B 23/0245* (2013.01); *A43D 8/00* (2013.01); *A43D 8/003* (2013.01);
(Continued)

(58) Field of Classification Search
CPC ..... D06C 3/08; A43B 23/0245; A43D 8/00; A43D 8/003; B26D 7/015; B26D 7/025; D06H 7/00; D10B 2501/043
See application file for complete search history.

(56) References Cited

U.S. PATENT DOCUMENTS 3,988,993 A 11/1976 Brophy
4,072,461 A * 2/1978 Pirk ..... A43B 13/20 425/518
(Continued)

FOREIGN PATENT DOCUMENTS

CN 200988289 Y 12/2007
CN 201103043 Y 8/2008
(Continued)

OTHER PUBLICATIONS

International Preliminary Report on Patentability received for PCT Patent Application No. PCT/US2018/057366, dated May 7, 2020, 9 pages.
(Continued)

*Primary Examiner* — Eric J Rosen
*Assistant Examiner* — J Stephen Taylor
(74) *Attorney, Agent, or Firm* — SHOOK, HARDY AND BACON L.L.P.

(57) ABSTRACT

A manufacturing frame comprises one or more alignment tabs. Each alignment tab comprises an alignment element. The alignment element interacts with a corresponding alignment element at a manufacturing station to identify to the manufacturing station the position and orientation of the frame. The frame supports a flexible material in a known position and orientation relative to the frame, allowing the manufacturing station to infer the position and orientation of the flexible material on the frame from the interaction of the alignment elements on the frame and the manufacturing station.

20 Claims, 20 Drawing Sheets

(51) Int. Cl.

| | |
|---|---|
| ***B26D 7/01*** | (2006.01) |
| ***B26D 7/02*** | (2006.01) |
| ***D06H 7/00*** | (2006.01) |
| ***A43B 23/02*** | (2006.01) |

(52) U.S. Cl.
CPC ..... *B26D 7/015* (2013.01); *B26D 7/025* (2013.01); *D06H 7/00* (2013.01); *D10B 2501/043* (2013.01)

(56) References Cited

U.S. PATENT DOCUMENTS

| | | | | |
|---|---|---|---|---|
| 4,593,634 | A | 6/1986 | Moreno | |
| 4,660,308 | A * | 4/1987 | Dang | D06C 3/08 38/102.4 |
| 5,505,083 | A | 4/1996 | Hines et al. | |
| 6,394,012 | B1 | 5/2002 | French et al. | |
| 7,966,957 | B2 * | 6/2011 | Mack | D05C 9/04 112/103 |
| 8,321,984 | B2 | 12/2012 | Dojan et al. | |
| 8,850,678 | B2 | 10/2014 | Crisp et al. | |
| 2012/0272463 | A1 * | 11/2012 | Crisp | A43D 117/00 12/103 |
| 2013/0131854 | A1 | 5/2013 | Regan et al. | |
| 2016/0309850 | A1 | 10/2016 | Jurkovic et al. | |
| 2017/0157846 | A1 | 6/2017 | Miller et al. | |
| 2019/0116938 | A1 | 4/2019 | DeHaven et al. | |

FOREIGN PATENT DOCUMENTS

| | | | | |
|---|---|---|---|---|
| CN | 101525817 | A | 9/2009 | |
| CN | 101715390 | A | 5/2010 | |
| CN | 102041644 | A | 5/2011 | |
| CN | 202865579 | U | 4/2013 | |
| CN | 104350194 | A | 2/2015 | |
| CN | 204135925 | U | 2/2015 | |
| CN | 104889903 | A | 9/2015 | |
| CN | 105916688 | A | 8/2016 | |
| CN | 206034062 | U | 3/2017 | |
| EP | 2641497 | A1 | 9/2013 | |
| KR | 20-2013-0005802 | U | 10/2013 | |
| WO | 2010037039 | A1 | 4/2010 | |
| WO | WO-2015134263 | A1 * | 9/2015 | A43D 11/006 |
| WO | 2018102071 | A1 | 6/2018 | |

OTHER PUBLICATIONS

International Preliminary Report on Patentability received for PCT Patent Application No. PCT/US2018/057365, dated May 7, 2020, 10 pages.
International Search Report and Written Opinion dated Jan. 29, 2019 in International Patent Application No. PCT/US2018/057365, 16 pages.
Final Office Action received for U.S. Appl. No. 16/168,456, dated Nov. 15, 2021, 19 pages.
Non-Final Office Action received for U.S. Appl. No. 16/168,456, dated Mar. 15, 2021, 15 pages.
International Search Report and Written Opinion dated Mar. 25, 2019 in International Patent Application No. PCT/US2018/057366, 16 pages.
Intention to Grant received for European Patent Application No. 18800006.1, dated May 21, 2021, 5 pages.
Intention to Grant received for European Patent Application No. 18800423.8, dated May 27, 2021, 5 pages.
Extended European Search Report received for European Patent Application No. 21202385.7, dated Feb. 1, 2022, 10 pages.
Non-Final Office Action received for U.S. Appl. No. 16/168,456, dated Jun. 17, 2022, 16 pages.
Notice of Allowance received for U.S. Appl. No. 16/168,456, dated Jan. 18, 2023, 9 pages.
Office Action received for European Patent Application No. 21202385.7, dated Jun. 26, 2023, 5 pages.

* cited by examiner

MANUFACTURING FRAME

CROSS-REFERENCE TO RELATED APPLICATIONS

This application having U.S. patent application Ser. No. 16/168,364 and entitled "Manufacturing Frame" claims the benefit of priority of U.S. Provisional Application No. 62/576,600, entitled "Manufacturing Frame," and filed Oct. 24, 2017. Additionally, this application is related by subject matter to U.S. patent application Ser. No. 16/168,456, entitled "Agile Manufacturing Processes and Systems," which claims priority to U.S. Provisional Application No. 62/576,592, entitled "Agile Manufacturing Processes and Systems," and filed Oct. 24, 2017. The entirety of the aforementioned applications are incorporated by reference herein.

TECHNICAL FIELD

This disclosure relates to a frame for supporting material during a manufacturing operation. More particularly, the present invention relates to a frame for supporting a flexible material during a series of manufacturing operations.

BACKGROUND

Some manufacturing processes require moving in-process work materials between physically distinct manufacturing stations. Such stations may perform sequential operations that require knowledge of the location of the materials, securement of the materials to prevent them from moving relative to the manufacturing station and/or relative to one another, and/or tensioning of the parts. These functions may be provided by station-specific equipment, such as clips, pincers, pins or other devices associated with a particular station, possibly in conjunction with a vision system or human operator to help place or confirm the placement of landmarks on the work materials as needed at each manufacturing station. Alternately, these functions may be provided by a human or robotic operator that positions and maneuvers work materials at a particular station. These systems are cumbersome, complicated, and, particularly with human operators, prone to variation, error, and the possibility of injury.

BRIEF SUMMARY

This disclosure generally relates to a manufacturing frame. The frame may be used to secure materials during a series of manufacturing operations. It may be necessary or convenient to use two or more distinct manufacturing stations. When work materials are moved, it may be necessary to determine the position of the work materials relative to a manufacturing station. For example, a manufacturing station comprising a quilting arm must be positioned relative to landmarks on the work materials, such as an edge of or an aperture in the work materials, to properly place a seam. As another example, a manufacturing station comprising a cutting tool must be positioned and oriented in a particular way relative to the work materials to properly cut the material to match a desired pattern. Similarly, it may be desired to keep the work materials at a particular tension. For example, it may be desired to keep the parts in a neutral tension, or slack, or taught. The frame as disclosed can secure flexible work materials at a desired tension. The frame may be rigid and/or resistant to torsion, to prevent changes in tension and/or location of the work materials during manufacturing operations.

The frame may include an alignment tab. The alignment tab may have an alignment element that is configured to interact with a corresponding alignment element at a manufacturing station. The alignment elements cooperate to inform the manufacturing station of the position of the frame and the position of any material(s) on the frame. The alignment elements can therefore be used to define an origin for the manufacturing station, and to locate the work material(s) relative to that origin. In this way, the frame allows for the movement of the work material(s) between manufacturing stations without having to reassess the position of or reposition the work material(s) in order to continue sequential operations. The alignment elements may be sufficient to locate the work materials without visual inspection or repositioning of the work material(s).

These and other possible features of the claimed invention are described in further detail below.

BRIEF DESCRIPTION OF THE SEVERAL VIEWS OF THE DRAWING

This disclosure refers to the attached drawing figures, wherein.

DETAILED DESCRIPTION

Figure 1:
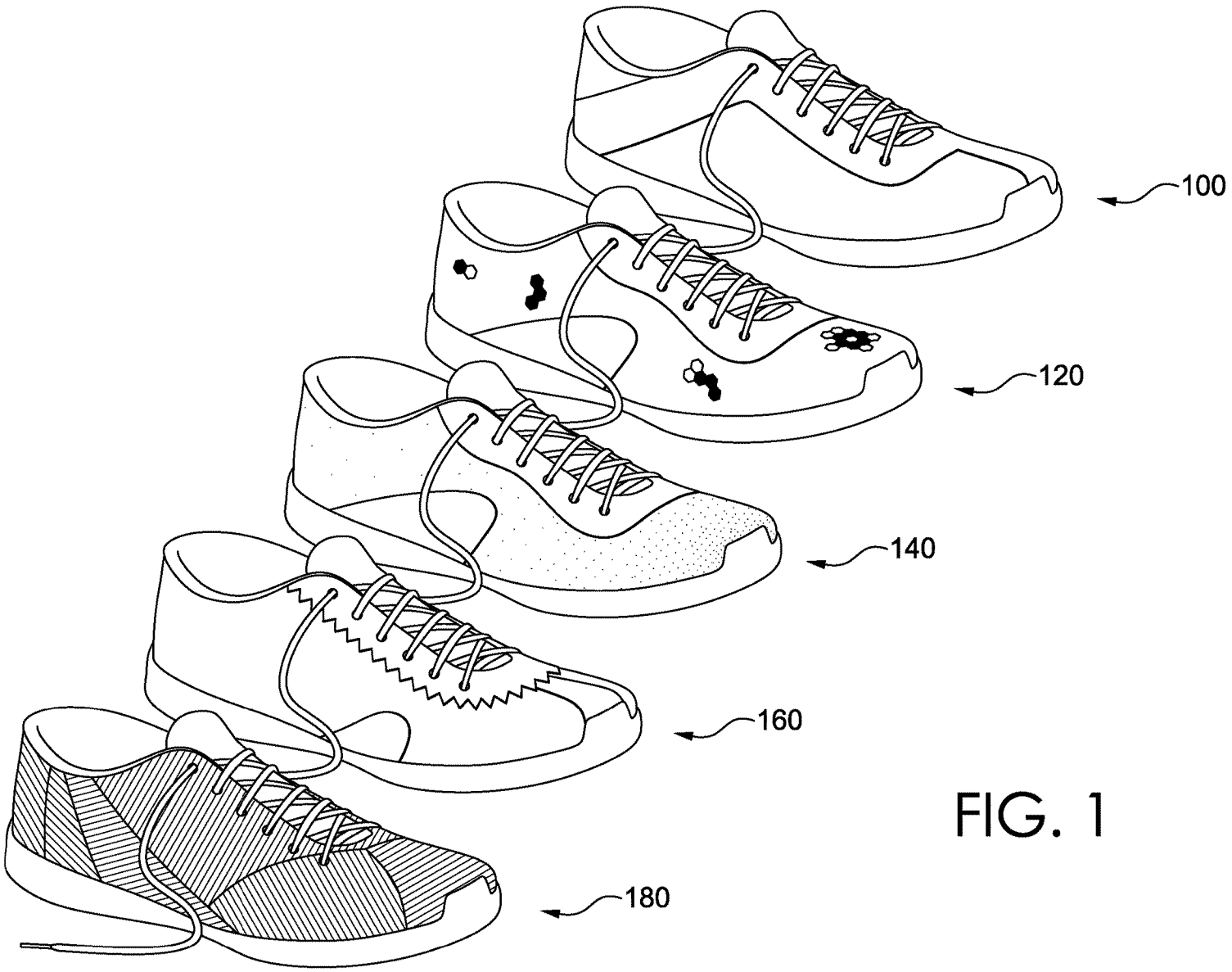
FIG. 1 depicts a variety of exemplary shoes in accordance with aspects of this disclosure.

Working with flexible materials, such as non-woven materials, fabrics, and films, can be challenging during manufacturing. The materials can fold back on themselves or under themselves, drape in undesired ways, shift position, or otherwise thwart efforts to keep the parts in a particular spot or orientation during manufacturing. Movement of these materials can cause terminal defects in, for example, seams or joints between parts, cut lines, and aesthetics. For example, parts may be cut to the wrong shape or size if the material(s) are not positioned as intended relative to a cutting blade. As another example, a material in a stack of two or more materials might not be joined to any other material in the stack if the material has folded onto itself and does not pass under a sewing needle or quilting arm. An improperly positioned part that is glued or seamed out of position may be ugly or non-functional because of the misplacement.

Conventional efforts to maintain the position of small and/or flexible parts have been cumbersome, involving, for example, vacuum or suction-based securement of parts to a surface, the involvement of a human equipment operator, or expensive vision inspection systems. Some of these approaches may impede certain manufacturing techniques. For example, a surface equipped with vacuum or suction may be very large relative to the operating area of a particular piece of manufacturing equipment, such as a sewing machine. A solid, continuous surface may also create mechanical interference with some devices that require clearance under the work piece, or even prevent work on the backside of a work piece.

In some aspects, a frame for use in manufacturing is disclosed. The frame has a long side and a short side. The frame has a perimeter defined by the long side, a second, opposing long side, the short side, and a second, opposing short side. The frame comprises a first alignment tab extending from the frame long side. The first alignment tab comprises an alignment element. The first alignment tab and the alignment element allow for positioning of the frame at a manufacturing station at a known location for a manufacturing process to occur within a center area defined by the perimeter The frame may comprise a second alignment tab, the second alignment tab comprising a second alignment element. The second alignment tab, if present, may extend from the frame long side, in an orientation the same as an orientation of the first alignment tab. The first alignment tab may be within 150 mm of the frame short side. The second alignment tab may be within 150 mm of a second frame short side. The alignment element of the first tab may be positioned symmetrically about a center axis of the frame to the second alignment element. The alignment element of the first tab may be positioned asymmetrically about a center axis of the frame to the second alignment element. The alignment element may protrude from the alignment tab. The alignment element may be a discontinuity in at least the surface of the alignment tab. The frame may comprise a tensioning element for securing a material within the frame. The frame may comprise a support structure for supporting a material within the frame. The support structure may be discontinuous.

In some aspects, a frame for use in manufacturing comprises a first frame. The first frame comprises a plurality of magnetic elements secured to the first frame. The first frame comprises a first plurality of pins secured to the first frame, wherein the first plurality of pins are positioned around the first frame for securing a material extending across a center area of the first frame. The first frame comprises a first aperture extending through the first frame. The frame comprises a second frame configured to coextensively mate with the first frame. The second frame comprises a second plurality of magnetic elements secured to the second frame. The first plurality of magnets and the second plurality of magnets are cooperatively positioned to magnetically attract the first frame and the second frame in the coextensively mated configuration. A solid portion of the second frame is configured to align with the first aperture of the first frame when in the coextensively mated configuration with the second frame. The frame comprises an alignment tab extending from the frame when the second frame is coextensively mated with the first frame. The frame may be rectilinear. The frame may comprise aluminum or steel. The first plurality of pins may comprise at least 40 pins. The first aperture may not extend through the second frame.

In some aspects, a method of performing manufacturing operations on opposite faces of a material maintained by a frame is disclosed. The method comprises positioning the frame at a first manufacturing station with a first face positioned toward a first manufacturing operation to be performed at the first manufacturing station. The method comprises aligning the frame at the first manufacturing station with a first alignment tab extending from the frame mechanically engaged with the first manufacturing station. The method comprising performing the first manufacturing operation on a first face of a material maintained by the frame, wherein the material first face and the frame first face are similarly oriented. The method comprises positioning the frame at a second manufacturing station with a second face positioned toward a second manufacturing station with the first alignment tab extending from the frame mechanically engaged with the second manufacturing station. The method comprises performing the second manufacturing operation on a second face of the material maintained by the frame. The material second face and the frame second face are similarly oriented. The orientation of the frame may not change between the first manufacturing station and the second manufacturing station. Performing the first manufacturing operation may comprise setting an origin relative to the alignment tab. The second manufacturing operation may comprise setting an origin relative to the alignment tab, without visual confirmation of the placement of the first manufacturing operation.

The manufacturing equipment and methods described could be used to manufacture a variety of products and intermediate components for products. For example, the manufacturing frame could be used to produce clothing, outerwear, wearable accessories such as hats and scarves, disposable articles such as shoe covers and rain ponchos, pillows and other home décor, and other products or product components that contain textiles, non-woven fabrics, films or other thin, flexible materials. In some aspects, the equipment and methods may be used to produce shoes, and more particularly, shoe uppers.

Even for similar shoes, such as the sneakers depicted in FIG. 1, the design of the upper may vary significantly from a manufacturing perspective. For example, although shoes 100, 120, 140, 160 and 180 are similar in shape and structure, they have design elements that make different manufacturing processes necessary or convenient. For example, shoe 100 includes aesthetic elements, possibly stitching, printing, or added material, to form patterns under the ankle opening and at the toe-end of the shoe upper. In contrast, shoe 120 includes a more-or-less uniform fabric in most of the design of the shoe upper. Shoe 140 includes added materials forming a design at the heel and ankle-opening portions of the shoe upper. Shoe 160 includes contrasting materials sewn in to the toe-end of the shoe upper and along the mid-foot and ankle opening regions of the shoe upper. And shoe 180 includes a single material with a directional pattern assembled in small patches to create a multi-directional pattern across the shoe upper. Across these designs, the assembly processes vary, sometimes significantly, even though the general pattern for the shoe upper remains constant. Of course, with variation in the structure of the shoe—the positioning of the laces, shape and attachment of the tongue, presence or absence of piping, lining or edging, etc.—the number and magnitude of changes needed in the manufacturing process can increase rapidly.

Figure 2:
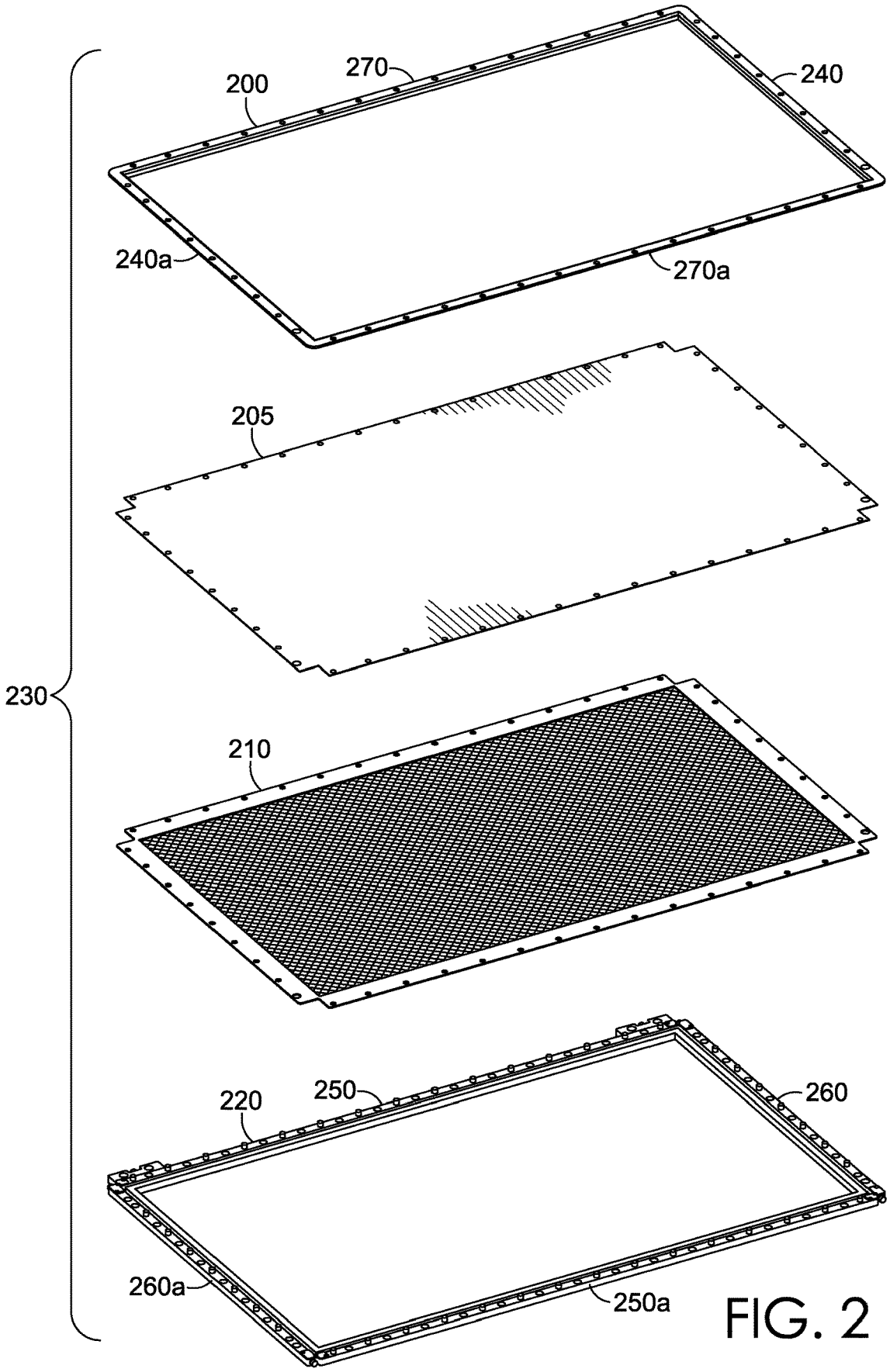
FIG. 2 depicts an exemplary manufacturing frame in accordance with aspects of this disclosure.

FIG. 2 shows an exemplary manufacturing frame 230 that could be used, for example, to make a shoe upper or a portion of a shoe upper. Frame 230 comprises a top frame 200 and a bottom frame 220. The top frame has a long side 270 and a short side 240. The bottom frame has a corresponding long side 250 coextensive with top frame long side 270 and a corresponding short side 260 coextensive with top frame short side 240. Because the frame as shown in FIG. 2 is rectilinear (or approximately rectilinear, since the corners are rounded), the top frame has a second long side 270*a* and a second short side 240*a*, and the bottom frame has a corresponding second long side 250*a* and a corresponding second short side 260*a*. However, the frame could have other shapes, including, without limitation, oval, square, triangular, irregular, etc.

Optionally, the frame 230 may further include a support structure 210 positioned between top frame 200 and bottom frame 220. As shown, support structure 210 is a grid or mesh, which may facilitate certain manufacturing operations, such as needlework, like sewing, embroidery, edging, etc. Depending on the requirements of particular manufacturing process, it may be desirable to have a discontinuous surface, such as a grid or mesh or a surface with cut-outs that pass through portions of the area within the perimeter of the frame 230. Under other circumstances, a solid support structure 210 may be desirable. For example, the support structure may facilitate heating (as by having a high effusivity, high heat transfer coefficient, or, conversely, a low thermal insulance, by induction heating, or otherwise) or cooling, or could serve as an anvil for sonic welding. As another example, the support structure may provide resistance for stamping or embossing operations. Under still other circumstances, no support structure 210 may be necessary or desirable. As described below, support structure 210 may be designed to facilitate creating a material within the frame 230, as by additive deposition. In other aspects, the frame may be assembled with material 205 layered between the top frame 200 and the bottom frame 220. The material 205 is shown layered over support structure 210 (i.e., closer to the top frame 200), but could be positioned below support structure 210 (i.e., closer to the bottom frame 220), or directly between top frame 200 and bottom frame 220, if no support structure 210 is used. It should be understood that material 205 is described in the singular, but could be a laminate, distinct layers, or other mixes of materials, at the start of the manufacturing process or as the manufacturing process proceeds. Material 205 may be pliable. That is, if material 205 is suspended under its own weight, as in a fabric drape test, the material will not remain within ±35° of a plane.

Support structure 210, if used, may be a conventional material that is incorporated into the product (that is, support structure 210 may be starting material 205), or the support structure 210 may be destroyed in the course of processing material 205 and/or removing a finished part or part component from frame 230 and/or support structure 210, or the support structure 210 may be a reusable structure that is not incorporated into the part or part component. An exemplary support structure 210 is a woven film of Teflon and/or glass. Additional non-limiting materials that might be suitable for use as a support structure include fiberglass, embroidery floss, polyester, organic cotton, nonwoven fabrics, or combinations thereof. If support structure 210 is a material with a low surface energy that might slip against gasket 393, gasket 390 or gasket 395 (if used), support structure 210 may be joined, as by sewing, thermal bonding, adhesive bonding, etc., to an edge material with a higher surface energy or a textured surface that would be less likely to slip against the gasket.

As shown in FIGS. 3A-H, the frame 230 may have a variety of embedded structures. For example, frame 230 may comprise one or more ejection pins 300. In some aspects, ejection pins 300 may be present in top frame 200 or bottom frame 220, or both the top frame 200 and the bottom frame 220. As shown, bottom frame 220 comprises ejection pins 300 and top frame 200 does not. Reference numbers 360 highlight the flat surface of top frame 200 corresponding to the location of ejection pins 300. In this way, applying pressure to the ejection pins 300 may separate the top frame from the bottom frame, by pushing the top frame away from the bottom frame.

Frame 230 may further include one or more alignment pins 310. Alignment pins 310 may be present in the top frame 200, or the bottom frame 220, or in a complementary pattern on the top frame 200 and bottom frame 220 (to allow mating of the top frame 200 and bottom frame 220). As shown, alignment pins 310 protrude from an upper surface of bottom frame 220, and correspond to holes 370 in top frame 200. This allows a lower surface of top frame 200 to sit flush against the upper surface of bottom frame 220 when alignment pins 310 are aligned with holes 370. Holes 370 may, but do not have to, go completely through the thickness of top frame 200. Rather, holes 370 should be approximately of the same height into top frame 200 as the height of alignment pins 310 from the upper surface of bottom frame 220. The alignment pins 310 are shown as having the same shape and size as one another, but different alignment pins could be used. For example, alignment pins of different heights and/or cross-sections could be used to insure that the frames are oriented as desired. The placement of the alignment pins could also or alternatively differ along a side of the frame or along different sides of the frame. The spacing of the alignment pins could be uniform along a portion of the perimeter of the frame 230, or along the entire perimeter of frame 230, or could be irregular and/or asymmetric about a center line (along the x-axis or the y-axis) of the frame 230.

Any desired number of alignment pins 310 could be used, from one pin or two pins for the entire frame to as many pins as dimensionally fit on the frame. In some aspects, the alignment pins 310 may be used to orient and/or help secure a flexible material inside the frame. For example, the material may have apertures or be processed to create apertures that fit over the alignment pins. In some aspects, a relatively high number of pins may be desirable, such as greater than 30 pins, or at least 40 pins, or 46 pins. For some working materials and manufacturing operations, as few as 2 pins might work, or 8 pins, or 12 pins. It may be desirable to place alignment pins 310 at intervals between 60 mm and 360 mm (inclusive of endpoints) around the perimeter of the frame 230. If the intervals are irregular, it may be desirable to place the pins no more than 360 mm apart. If the pins are the primary securement mechanism for holding the material in place within the frame, a relatively high number of pins may help prevent the material from moving during manufacturing operations, where relatively small shifts in position—on the order of mm—could sometimes cause a defect in the product or product component. The alignment pins may also be used to align support structure 210, if used. Alternately, support structure 210 could sit between bottom frame 220 and top frame 200 without seating support structure 210 on an alignment pin, particularly, but not exclusively, if support structure 210 is uniform throughout the area 350 within the frame 230 (e.g., a uniform mesh or grid, a uniform solid surface, etc.). Seating one or more apertures in support structure 210 on one or more alignment pins 310 may be more helpful where the support structure 210 is discontinuous or non-uniformly patterned, making the placement of the support structure 210 relative to the frame 230 more important for location determination, as described in further detail below. If the support structure 210 and/or working material 205 are seated on the alignment pins 310, they may be seated on all of the alignment pins 310 present on frame 230, or may be seated on only a subset of the alignment pins 310. If both support structure 210 and working material 205 are seated on a subset of alignment pins 310, they may be seated on the same subset of alignment pins 310, or different subsets of alignment pins 310, or overlapping subsets of alignment pins 310.

The frame may include magnets 320. Magnets 320 may be of opposite polarity in the top frame 200 and bottom frame 220, and may tend to secure the top frame 200 to the bottom frame 220. If magnets are used, it is desirable that they be of sufficient strength to hold the frame together during manufacturing processes. If the frame is to be reused, it is desirable that the magnets be of sufficiently limited strength that the top frame can be separated from the bottom frame to remove parts or spent materials after processing is complete. One of skill in the art will appreciate that these bounds depend on the particular processes used. For example, the magnets may need to be stronger for punching or embossing operations than for some cutting or needlework operations. As another example, relatively weaker magnets may be desirable if the frames are opened by hand by a human operator than if the frames are opened using a pneumatic tool or machine. The number and spacing of the magnets can also be varied to achieve the desired attraction of the bottom frame 220 to the top frame 200. Alternatives to magnets could serve as closures for the frame 230, including, without limitation, screws, bolts-and-nuts, clamps, ties, anchors, hook-and-loop tape, adhesives, and the like. Magnets have been found to be amenable to efficient, automated frame assembly and disassembly, as described in further detail below.

Figure 3A:
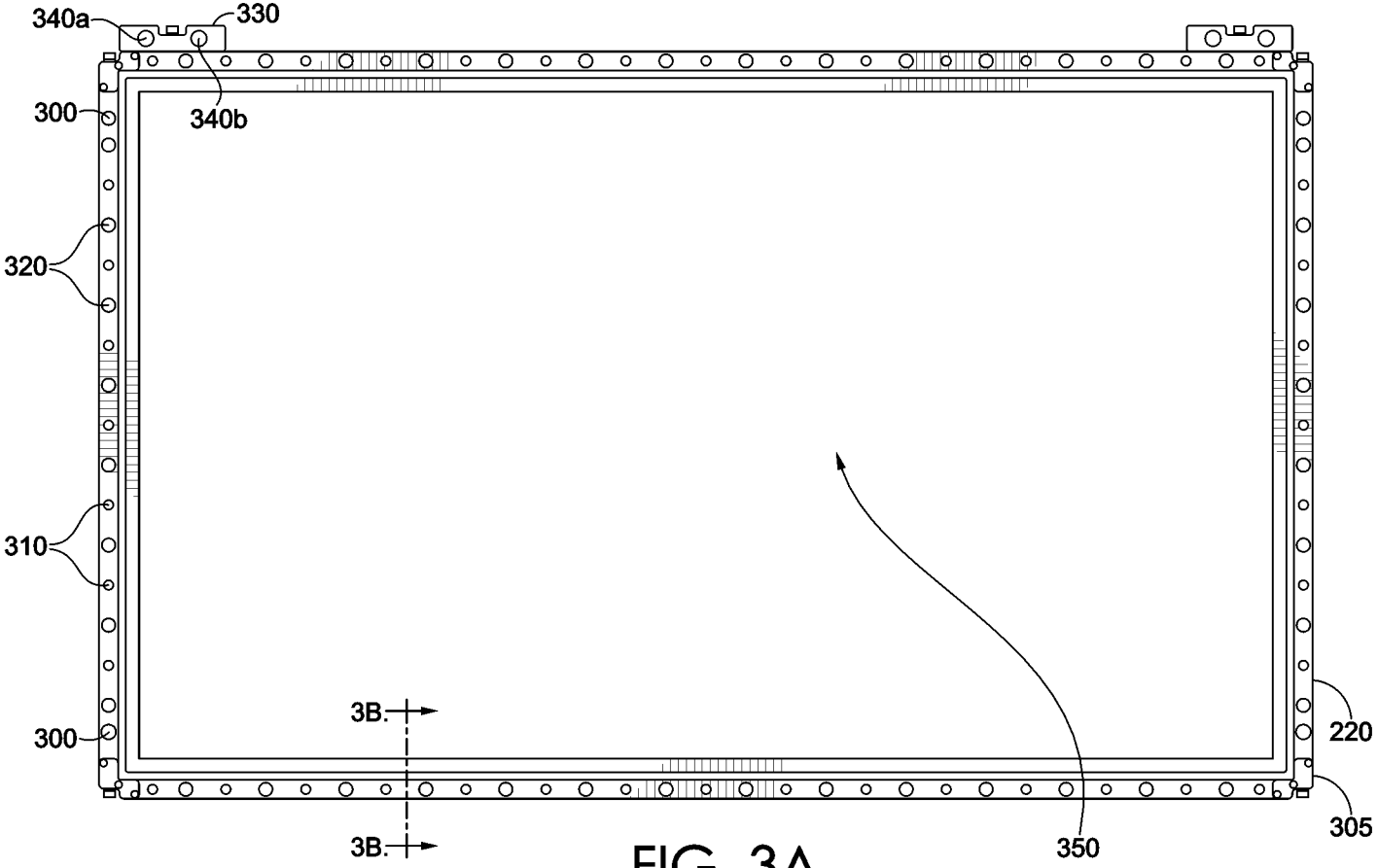
FIGS. 3A-H depict select details of an exemplary manufacturing frame in accordance with aspects of this disclosure in accordance with aspects of this disclosure.

As shown in FIG. 3A, frame 230 may comprise one or more stand-offs 305. Stand-offs 305 may be used to create a fixed distance at the junction 398 between top frame 200 and bottom frame 220 when the top frame 200 are in a mated configuration (as shown in FIG. 3H). The use of stand-offs 305 to create a fixed space prevents the material 205 and/or support structure 210 from defining the spacing between the frames, giving a consistent frame structure. The distance created by the stand-off could be greater than 0 and less than 1 mm, or between 1 mm and 2 mm (inclusive of endpoints) or greater than 2 mm, depending on the nature of the materials 205 and/or support structure 210 being used in the frame. In different manufacturing processes or with different materials, different stand-offs 305 could be used with what is otherwise the same frame 230.

Figure 3D:
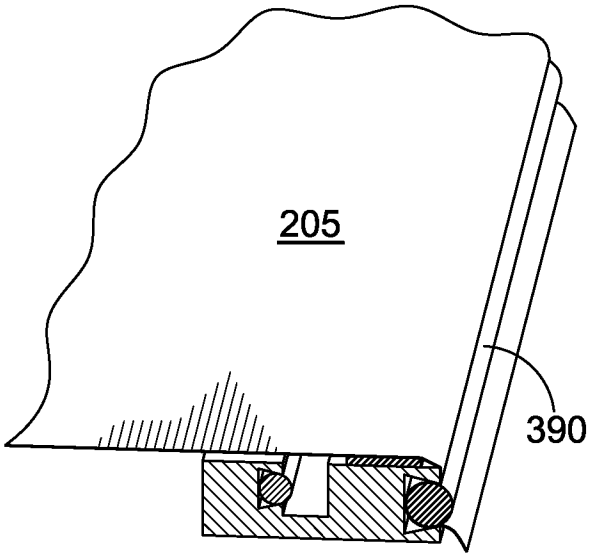
Figure 3C:
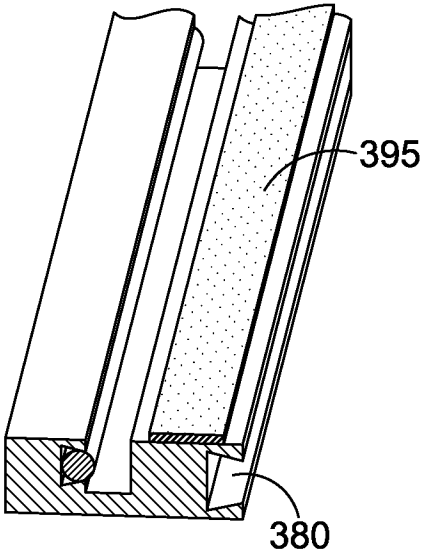

As shown in the exploded view of the top surface of bottom frame 220 in FIGS. 3C and 3D, the frame may comprise a gasket 395. The gasket is shown on the top surface of bottom frame 220, however, the gasket 395 could be attached to the bottom surface of top frame 200, or there could be a gasket 395 on both the top surface of bottom frame 220 and the bottom surface of top frame 200. The gasket may be compressible, and may serve to help secure a support structure 210 and/or working material 205 within the frame. Alternately or additionally, as shown in FIG. 3C, the top frame 200 (or bottom frame 220, not shown) may have a groove or indentation 380 along an outer surface of the frame. A gasket 390 may be configured to sit in a press-fit configuration in the indentation 380, as shown in FIG. 3D. A portion of support structure 210 and/or working material 205 may wrap at least partially around the outer surface of frame 230, and the gasket 390 may sit over the support structure 210 and/or working material 205 within the indentation 380, as shown in FIG. 3D. Gasket(s) 395 and/or 390 may be used to help secure support structure 210 and/or working material 205, and may help to regulate the tension on the working material 205 during manufacturing operations. A gasket may be particularly useful, but not exclusively useful, for securing working material 205 where a relatively low number of alignment pins are used, or where working material 205 may be prone to ripping or unraveling if apertures are made in working material 205 to accommodate one or more alignment pins 310. In some embodiments, a single part frame 230 (i.e., without separate top and bottom frames) may be used with a gasket as shown in FIG. 3D to secure material 205 and/or support structure 210 to the frame 230, or, alternatively, the bottom frame 220 may in some instances be used without a top frame 200 by securing material 205 and/or support structure 210 to the bottom frame 220 using gasket 390. The gasket 390 in FIG. 3D is shown as a solid rod, but could be hollow (e.g., a tube), and could be continuous or discontinuous around the perimeter of the frame 230. Any suitable material may be used for gasket 390 (or gasket 395 or gasket 393) including, without limitation, rubber (including latex, BUNA and nitrile rubber), polypropylene, silicone, metal, foam, neoprene, PTFE, polycarbonate, vinyl, polyethylene, nylon, PVC, TPU, polyisoprene, and combinations thereof.

Figure 3B:
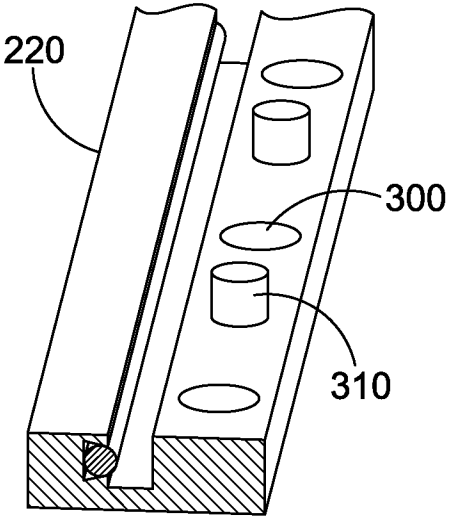
Figure 3E:
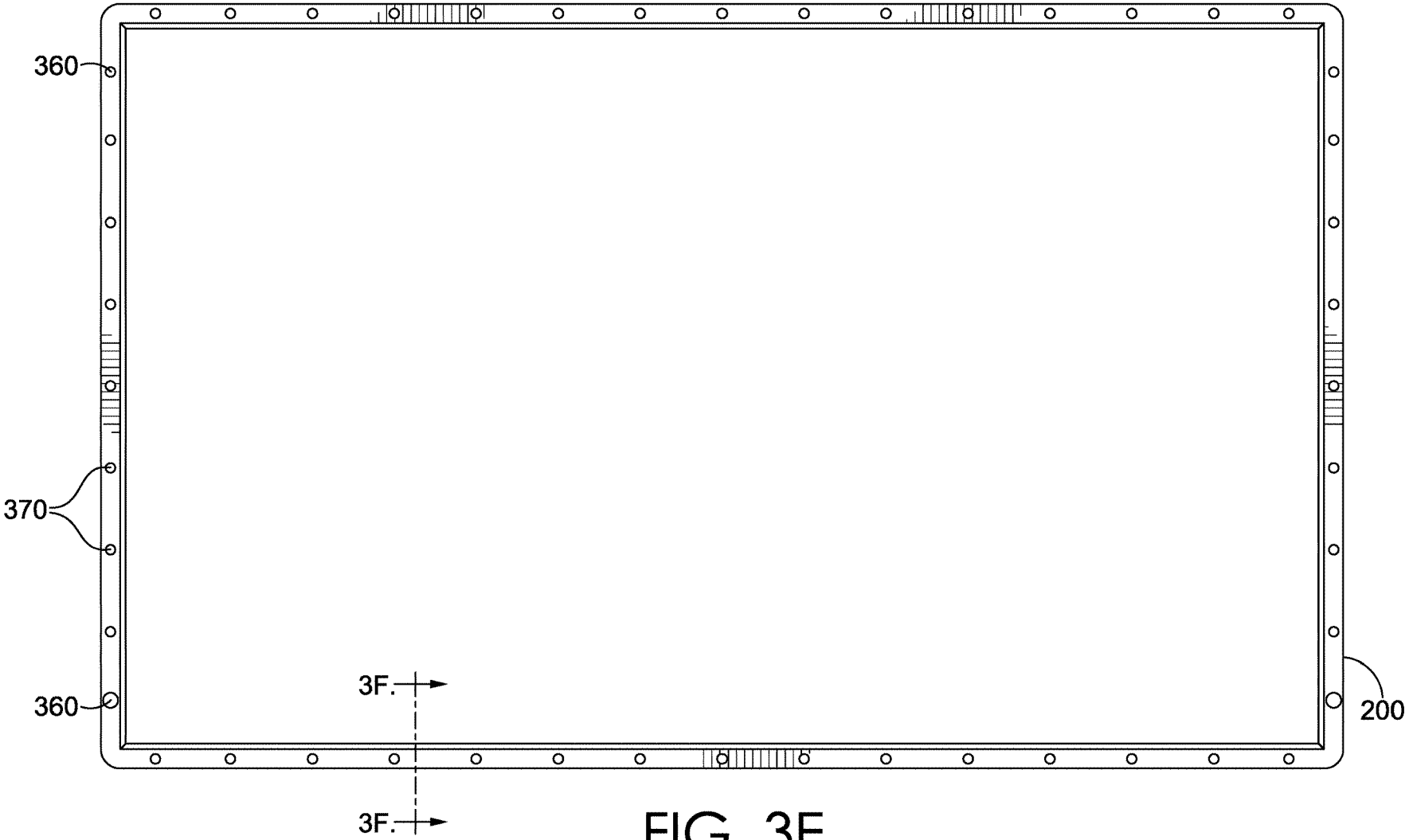
Figure 3H:
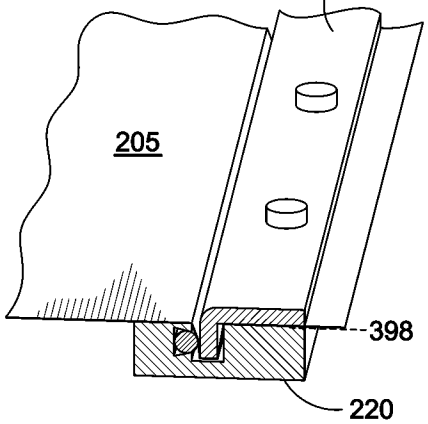

As depicted in FIGS. 3A and 3B, an alignment tab 330 extends from the bottom frame 220. The alignment tab 330 could extend from the top frame 200 or the bottom frame 220 or could be positioned between the frames and secured in place by a gasket 395 or 390, or could be secured in place by a press-fit around one or both of the top frame 200 and the bottom frame 220, or could be otherwise secured to the assembled frame (e.g., by screws, bolts, adhesives, putty, magnets, etc.). The alignment tab 330 includes at least one alignment element, and, as shown, includes two alignment elements 340*a*, 340*b* on the alignment tab 330. Alignment elements on the same tab may be of the same or different types (e.g., pins, apertures, other mechanical fasteners, adhesives, hook-and-loop fasteners, etc.) and the alignment elements on different tabs on the same frame may be of the same or different types.

More than one alignment tab 330 may be used, with each alignment tab 330 having at least one alignment element. If more than one alignment tab 330 is used, additional alignment tabs may extend from the same side of the frame (e.g., long side 270, opposite long side 270*a*, short side 240, opposite short side 240*a*, or corresponding sides of bottom frame 220), or from a different side of the frame, or from all sides of the frame. If placed on the same side, two or more alignment tabs 330 may be placed near opposite ends of that side. For example, a first alignment tab on long side 270 or 250 may be placed near short side 240 or 260, such as within 200 mm of the short side, or within 150 mm of the short side, or within 100 mm of the short side. A second alignment tab on long side 270 or 250 may be placed near short side 240*a* or 260*a*, such as within 200 mm of the short side, or within 150 mm of the short side, or within 100 mm of the short side. If more than one alignment tab is used, the alignment tabs may be of the same structure, and may be oriented similarly or differently (e.g., protrusion up, protrusion down, protrusions sideways, aperture up, aperture down, aperture sideways). If more than one alignment tab is used, the alignment tabs and/or their alignment elements may be symmetrical about a centerline (in the x-direction or in the y-direction) of the frame 230, or may be positioned asymmetrically.

The alignment element may protrude from the alignment tab 330. For example, the alignment element may be a pin or rod. Less pronounced protrusions should also work, however, a pin or rod may allow for additional precision in engaging the alignment element. Alternately, the alignment element may be an aperture or discontinuity in the surface of the alignment tab 330. The alignment element on alignment tab 330 may be engaged by an alignment element on a manufacturing station. For example, as shown in FIG. 5, a frame 230 may have two alignment tabs 330*a*, 330*b*, with alignment elements corresponding to alignment elements 520*a*, 520*b* on manufacturing station 500. Where the alignment element on alignment tab is a protrusion, the alignment element on the manufacturing station may be an aperture, discontinuity, or hole in the surface of manufacturing station, sized and configured to receive or engage the protrusion on alignment tab 330. Where the alignment element on alignment tab 330 is an aperture or discontinuity, the alignment element(s) 520*a*, 520*b*, as shown on manufacturing station 500, may be protrusions, such as a pin or rod, sized and positioned to engage the aperture or discontinuity on alignment tab 330. Other corresponding alignment elements could be used to engage the alignment elements on the alignment tab and the manufacturing station, including hook-and-loop fasteners, selective adhesives (including cohesives), nuts-and-bolts, screws, and the like. Pin-based engagement systems have the advantages of being relatively precise—an aperture can be sized and shaped to receive a specific pin and to hold the position of the pin with little variation—and relatively fast to engage and disengage—the pin is positioned over an aperture (or vice versa) and dropped or slid into place, or lifted out of or away from the aperture to disengage.

Figure 4:
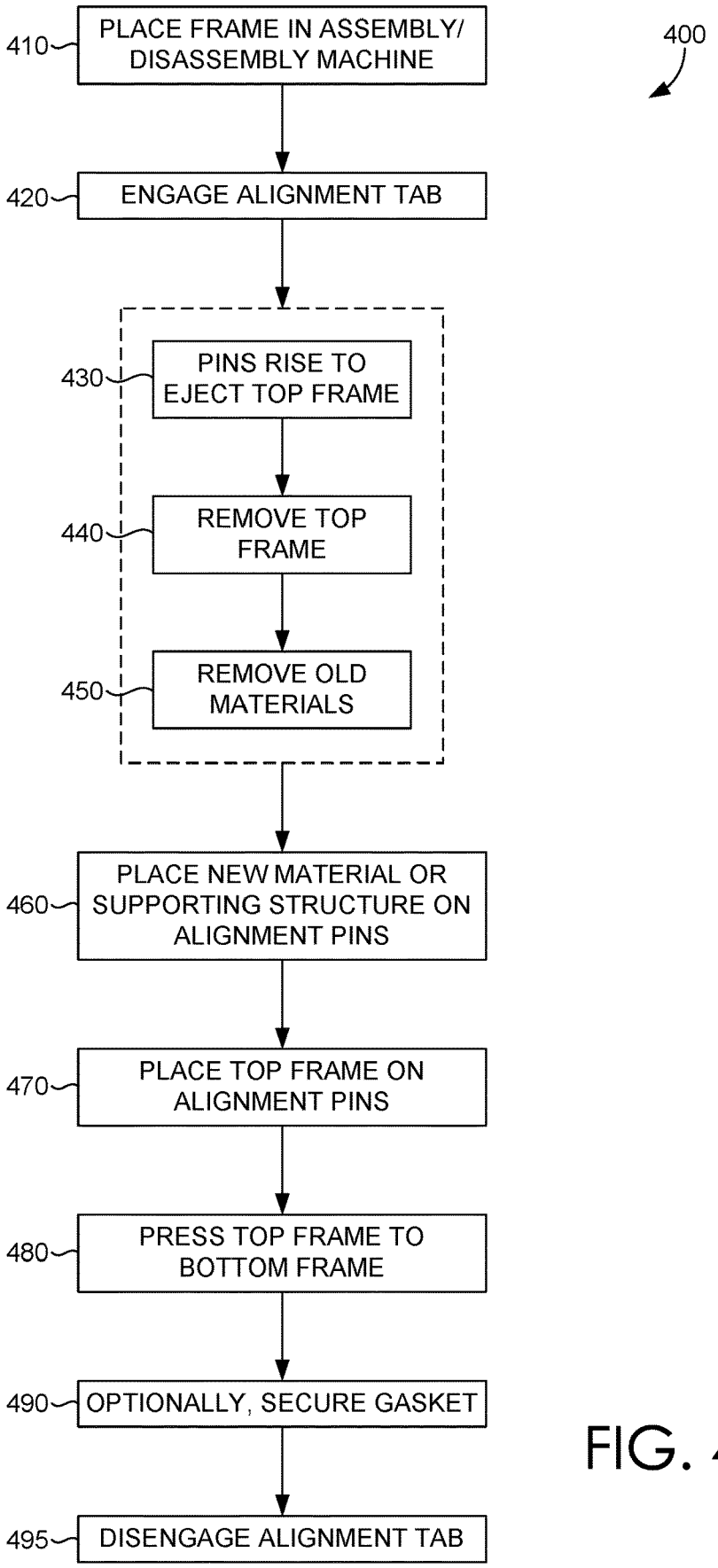
FIG. 4 depicts an exemplary flowchart for preparing a manufacturing frame for use in a manufacturing process in accordance with aspects of this disclosure.

The frame 230 may be prepared for use in a manufacturing process as depicted in FIG. 4. The frame 230 could be prepared manually, by a human operator. However, it may be desirable to prepare the frame using an automated process. In this case, frame 230 may be placed in an assembly/disassembly machine, shown as step 410 in assembly/disassembly process 400. The alignment tab 330 on frame 230 may be engaged by an alignment element on the assembly/disassembly machine, shown as step 420. At step 430 pins in the assembly/disassembly machine, configured to align with one or more ejection pins 300 in frame 230, may rise to separate top frame 200 from bottom frame 220, e.g., by exceeding the attractive force of magnets 320 in frame 230. If alternate closures are used, an additional and/or simultaneous step may be required to disengage the closure, e.g., by unscrewing screws or bolts, untying ties, unclamping clamps, etc.

At step 440, the top frame 200 is removed from the bottom frame 220. The top frame 200 is removed from the bottom frame 220 in that lower surface of the top frame 200 is distanced from the bottom frame 220. In some circumstances, this distance might just enough to remove or add materials between the top frame 200 and the bottom frame 220. In other circumstances, the top frame 200 could be moved away from the bottom frame 220, or vice versa, or even temporarily removed from the assembly/disassembly machine. At step 450, any material 205 and/or support structure 210 remaining in the frame from prior manufacturing operations, and which are no longer desired within the frame, may be removed from the frame, including alignment pins 310, if the material 205 and/or support structure 210 is engaged with the alignment pins 310. The materials removed may be the finished product or product component from prior manufacturing operations, or may be waste from prior manufacturing operations (e.g., if the finished product or product component was removed from the frame at a manufacturing station prior to moving the frame to the assembly/disassembly machine). Of course, if the frame is new or has no materials inside the frame, step 450, and potentially steps 430 and 440, may be unnecessary.

At step 460, new material 205 and/or support structure 210 may be placed in the frame. Placing the material 205 and/or support structure 210 in the frame may include seating the material 205 and/or support structure 210 on one or more alignment pins 310 in frame 230. If the support structure 210 from prior manufacturing operations is to be used again, the support structure 210 may remain in place during the assembly/disassembly processes. If the support structure 210 is intended to remain in place during assembly/disassembly of the frame, support structure 210 may have ejection pins or holes corresponding to frame 230 to facilitate the opening of the frame 230, or, alternatively, may have holes or cut-outs (e.g., irregularities in the perimeter of the support structure 210) so that the support structure is not present near the ejection pins or holes and does not interfere with opening the frame.

Once new material 205 and/or support structure 210 are placed on the frame, the top frame 200 is mated to the bottom frame 220 (if a top frame 200 is used). That is, top frame 200 may be placed on top of alignment pins 310 in bottom frame 220, or, alternatively, alignment pins 310 in top frame 200 may be placed on the bottom frame 220. The top frame 200 may be pressed against the bottom frame 220. This pressing may be used to compress any gaskets 395, material 205, and/or support structure 210 between the top frame 200 and the bottom frame 220 sufficiently to engage the closure system that will hold the top frame 200 and bottom frame 220 together during manufacturing operations (e.g., magnets 320). In some configurations, it will not be necessary to press the top frame 200 and bottom frame 220 together. For example, a magnet or tie-based closure system may pull the frame components together without exerting separate forces on the frame.

Figure 3G:
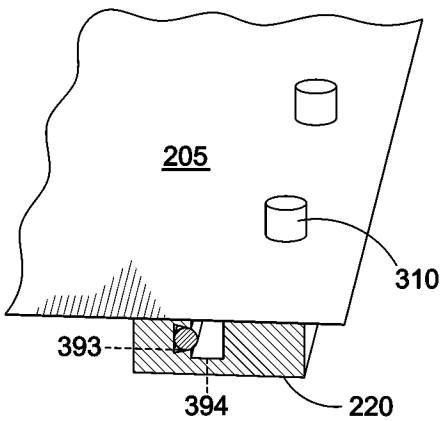
Figure 3F:
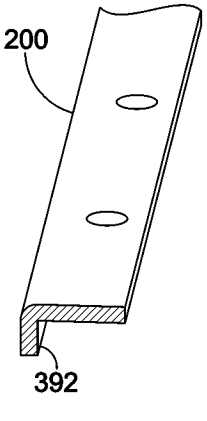

The top frame 200 may fit into bottom frame 220 using a tongue-and-groove structure, as shown in FIGS. 3F-H. As shown, a tongue 392, shown on top frame 200, fits into a groove 394 on bottom frame 220. However, the tongue could be placed on the bottom frame 220 and the groove placed on the top frame 200. An inner gasket 393 may be placed within the groove 394. When tongue 392 is placed into groove 394 over material 205 and/or support structure 210, inner gasket 393 is compressed, exerting a force that tends to press material 205 and/or support structure 220 against the tongue 392, holding the material 205 and/or support structure 210 in place. The inner gasket 393 is shown on one side wall of groove 394, but could be placed on the opposite sidewall of groove 394, or separate gaskets could be placed on each of the sidewalls of groove 394. Alternately or additionally, gasket 393 could be placed at the bottom of the groove 394, however, such a gasket may tend to apply an upward force against the tongue 392 (or a downward force against tongue 392, if tongue 392 is disposed on the bottom frame 220), and the press-fit, magnets, ties or other closures used to secure the frames together might need to be adjusted to accommodate that upward pressure to prevent the frames from tending to separate. Alternately, inner gasket 393 could be placed on a surface of the tongue 392, either side, both sides, bottom, or all three sides of tongue 392 that are placed in groove 394.

If a gasket 390 around an outer edge of frame 230 is used, it may be secured to the outer edge at step 490. Securing the gasket may involve wrapping portions of material 205 and/or support structure 210 around the frame 230. As noted above, gasket 390 could be placed in an indentation 380 in frame 230 over the wrapped portions of material 205 and/or support structure 210. Securing gasket 390 may be in addition to or in lieu of seating the new material 205 and/or support structure 210 on alignment pins 310 at step 460.

When the new material 205 and/or support structure 210 are secured and the frame 230 is closed, the assembly/disassembly machine may disengage the alignment tab 330. The frame 230 can be removed, manually or mechanically, from the assembly/disassembly machine.

Figure 5A:
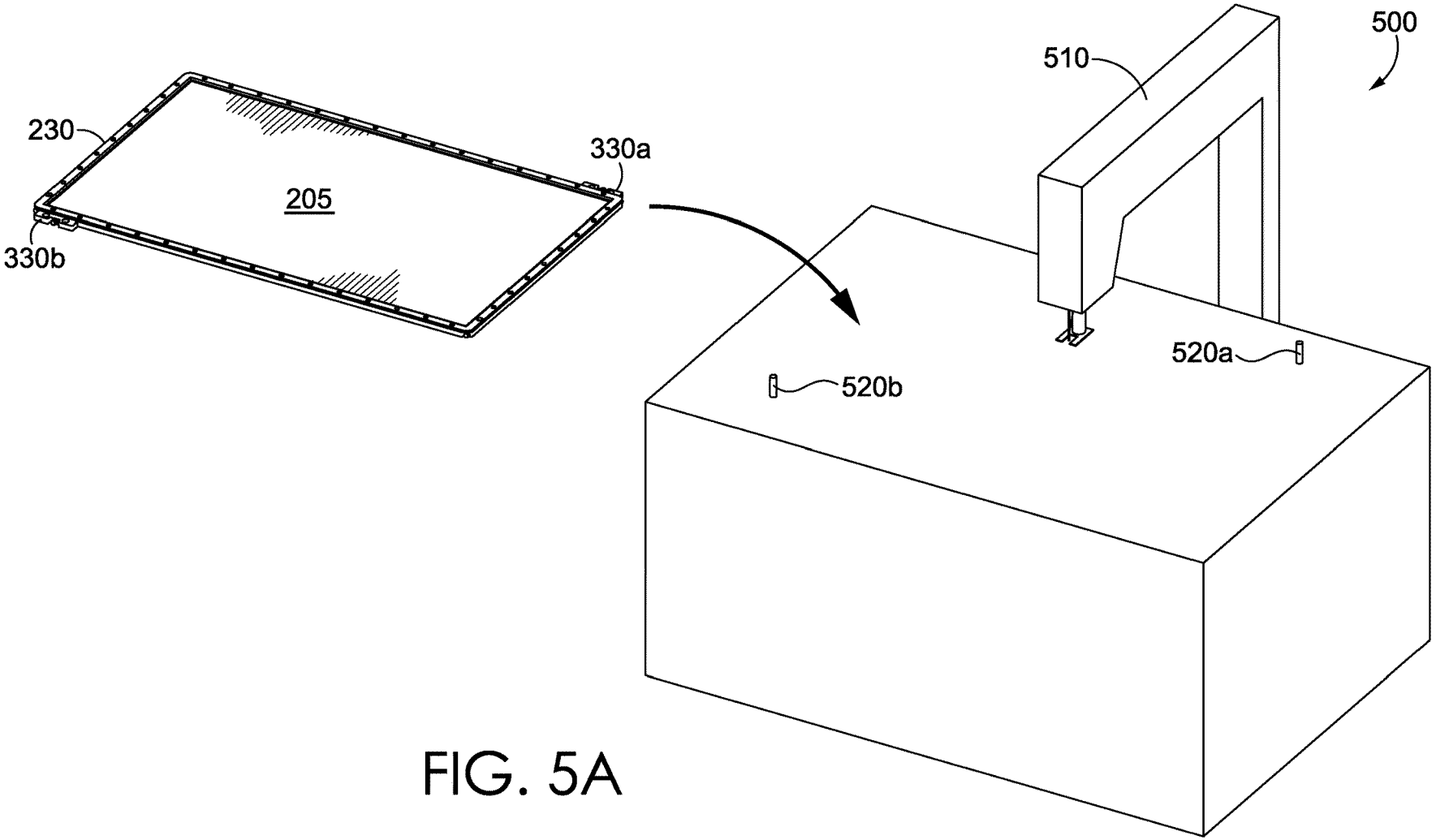
FIGS. 5A-B depict an exemplary interaction between corresponding alignment elements on a manufacturing frame and a manufacturing station in accordance with aspects of this disclosure.

An assembled frame 230 ready for manufacturing operations is shown in FIG. 5A with new material 205 secured in the frame 230. A support structure (not shown) may also be present. Alternately, a support structure 210 may be present with no new material 205. For example, the support structure 210 may be used during additive deposition operations, such as 3D printing, extrusion, spray deposition, etc., such that a material 205 is not originally present in the frame, but is deposited on the support structure 210 as part of the manufacturing operations performed with the frame 230. Of course, other materials could be placed on support structure 210 as part of the manufacturing operations, for example, lying textile components on the support structure as part of a manufacturing operation.

Figure 5B:
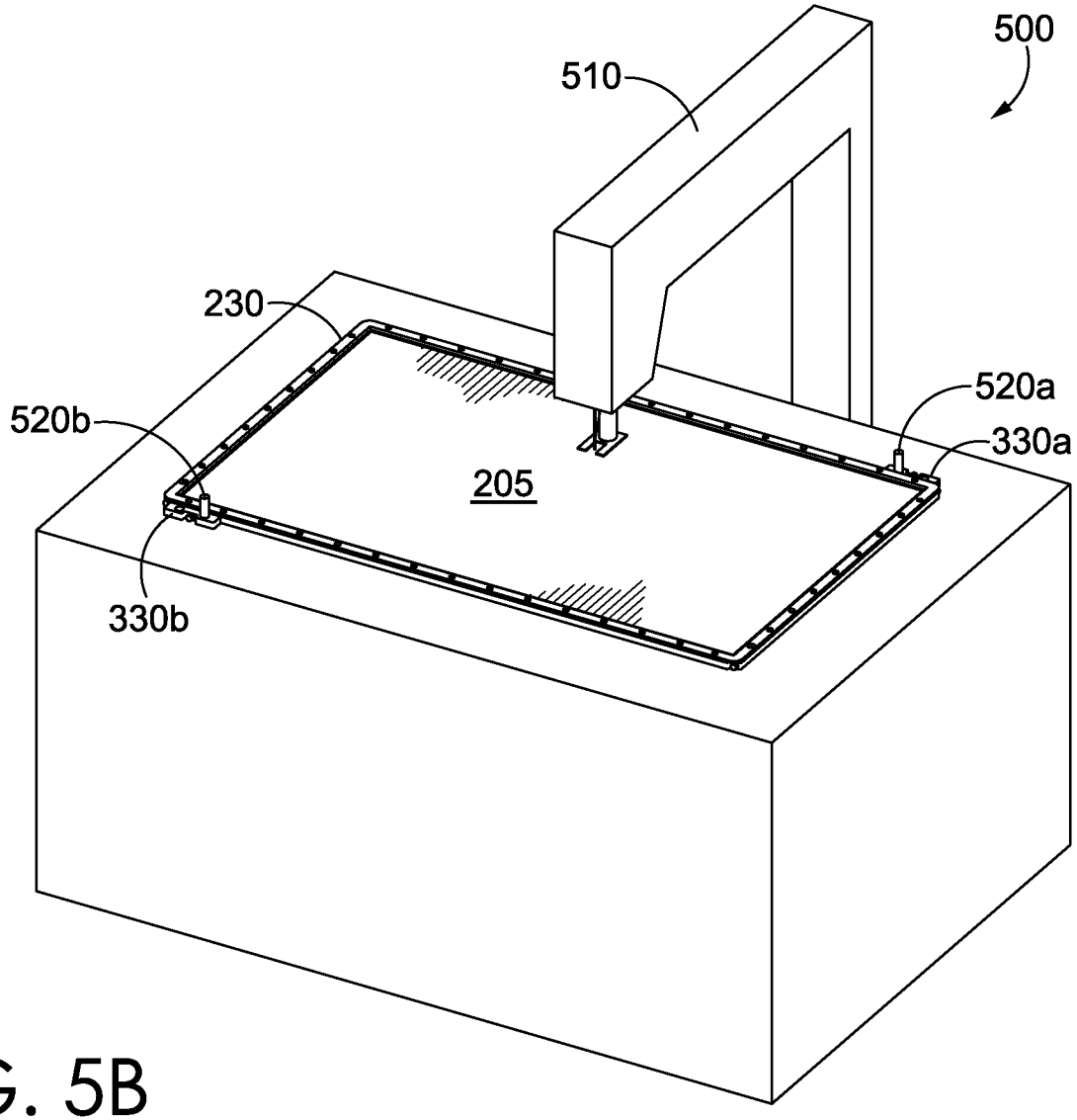

The assembled frame 230 is shown in FIGS. 5A-B with alignment tabs 330*a* and 330*b* on opposing long sides of the frame (e.g., long sides 270, 270*a* and/or 250, 250*a*). The alignment tabs could be placed in any location convenient for the manufacturing processes. In some circumstances, it may be desirable to space the alignment tabs apart from one another, to prevent the alignment tabs from jointly serving as a single point about which the frame 230 could rotate. In other circumstances, only one alignment tab may be used. The alignment tabs 330*a* and 330*b* interaction with alignment elements 520*a* and 520*b* at manufacturing station 500. As shown, alignment tabs 330*a* and 330*b* comprise apertures, and alignment elements 520*a* and 520*b* comprise raised protrusions from a surface of the manufacturing station 500 that can fit into the apertures on alignment tabs 330*a* and 330*b*. Alternately, alignment tabs 330*a* and 330*b* could comprise protrusions that fit into apertures on manufacturing station 500. Or alignment tabs 330*a* and 330*b* and alignment elements 520*a* and 520*b* could comprise any compatible, reversibly joinable systems, such as bolt-and-nut, screws, pins, hook-and-loop, adhesives (particularly, but not exclusively, selective adhesives, such as cohesives), clamps, press-fit mechanisms, and the like. If more than one alignment tab is used, different joining systems can be used with different tabs. For example, a first alignment tab 330*a* could include a protruding pin, and a second alignment tab 330*b* could include an aperture. As another example, a first alignment tab 330*a* could include a press-fit mechanism and a second alignment tab 330*b* could include a screw.

When the alignment tabs 330*a*, 330*b* on frame 230 are engaged with the alignment elements 520*a*, 520*b* at the manufacturing station 500, the frame is positioned in a known location and orientation relative to the manufacturing station 500, as shown in FIG. 5B. Without additional inspection or adjustment, a manufacturing operation can be performed with confidence in the location of the frame 230, and, indirectly, in the location of a material 205 and/or support structure 210 secured in the frame 230. As shown, manufacturing station 500 comprises a quilting arm 510, which could be used for seaming, embroidery, quilting, or other needlework. Such needlework can be positioned on material 205 with high precision based on the known location and orientation of the frame. If desired, a vision inspection system and/or human operator can verify the position of the frame 230, the position of the work material 205, and/or the quality of the outcome of a particular manufacturing operation. However, use of the vision inspection system and/or human operator inspection should not be required to confirm the location or orientation of the frame 230 or materials, and may be omitted, or may be used intermittently, e.g., on randomly selected parts, or on a part at arbitrary time or quantity intervals. If desired, a vision inspection system can be incorporated into a standalone manufacturing station (e.g., the manufacturing operation at that manufacturing station is visual inspection), or can be added as a supplemental piece of equipment and functionality to a manufacturing station that performs another manufacturing operation (apart from the visual inspection).

Figure 6A:
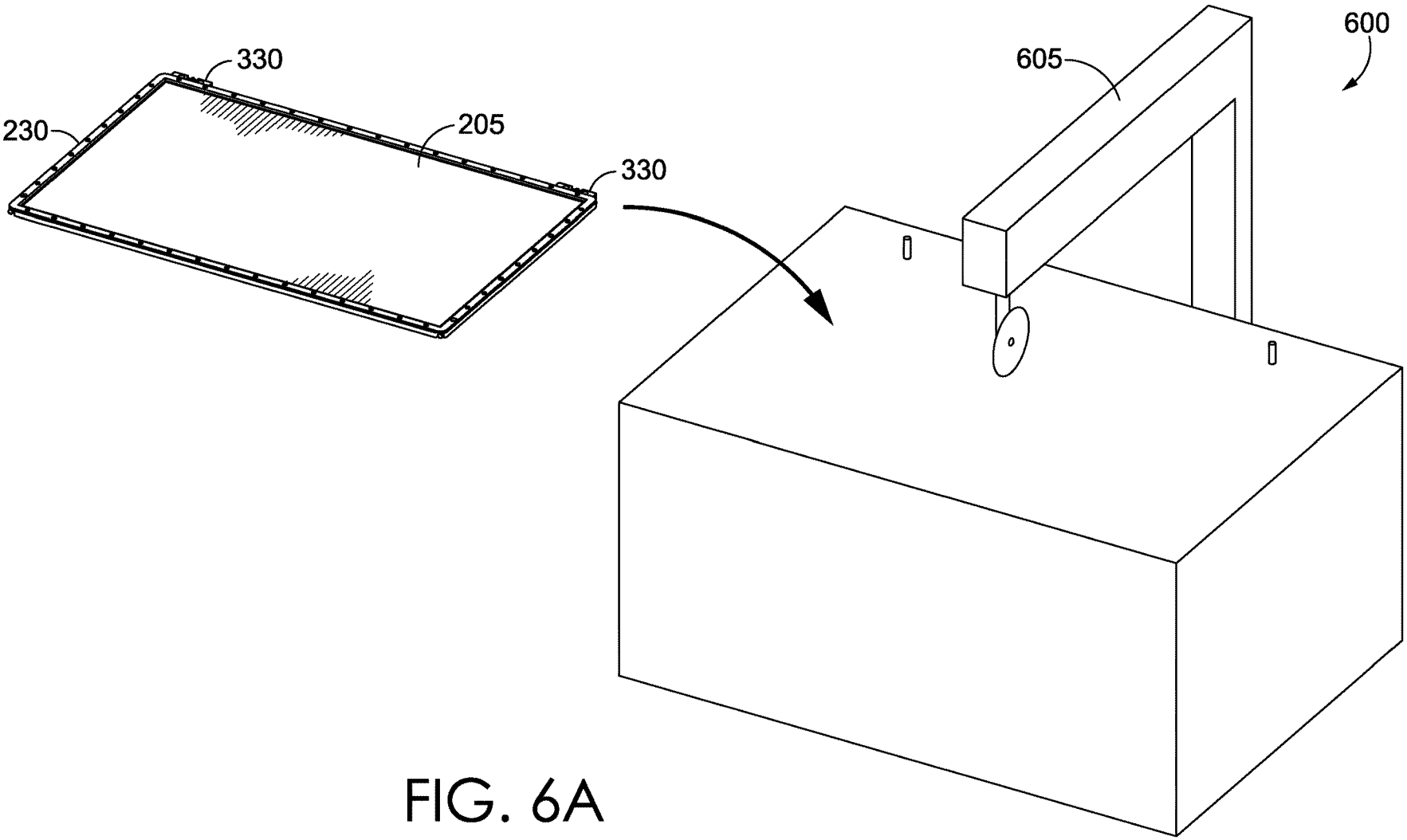
FIGS. 6A-E depict an exemplary series of manufacturing operations performed using a manufacturing frame in accordance with aspects of this disclosure.
Figure 6B:
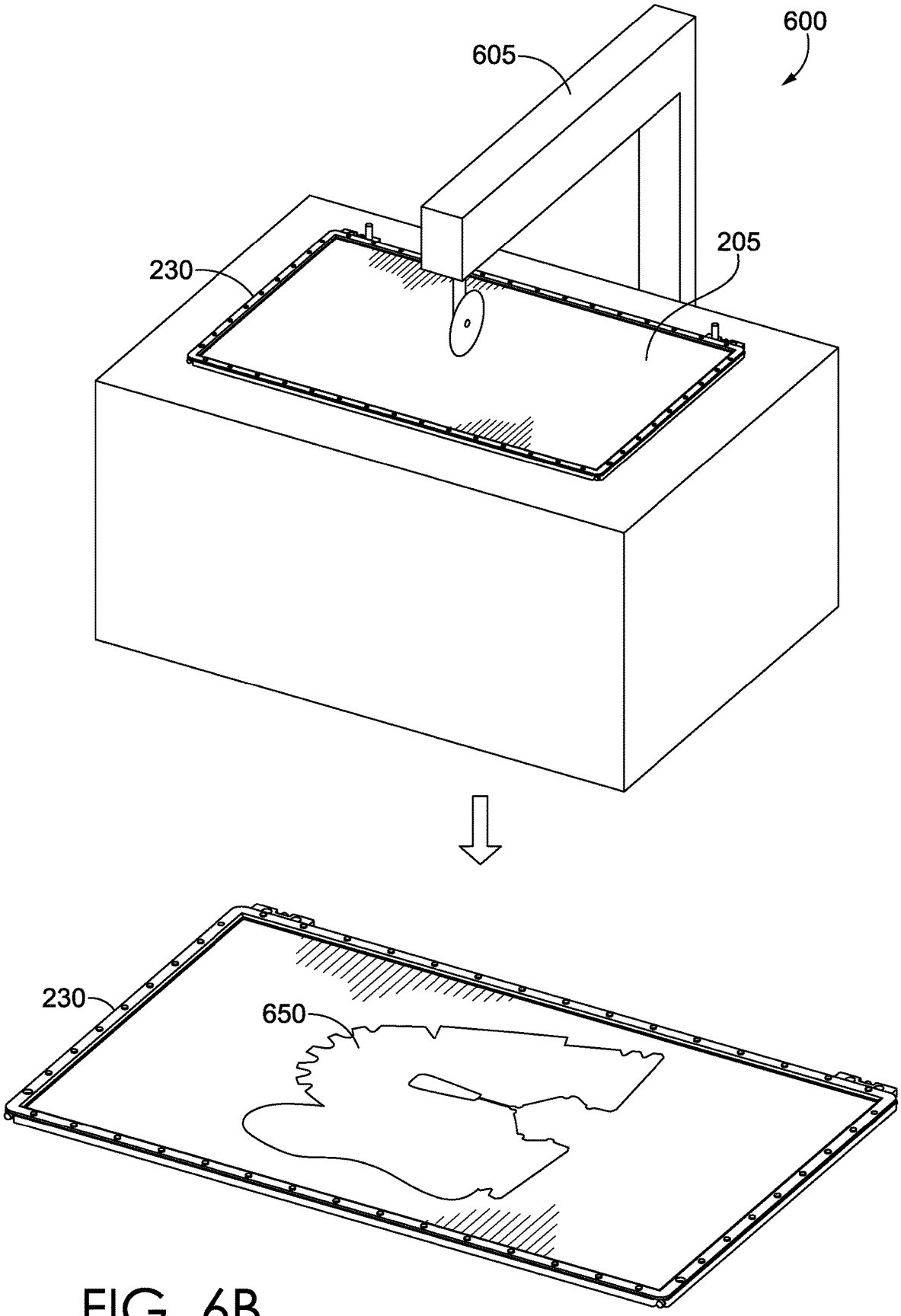
Figure 6C:
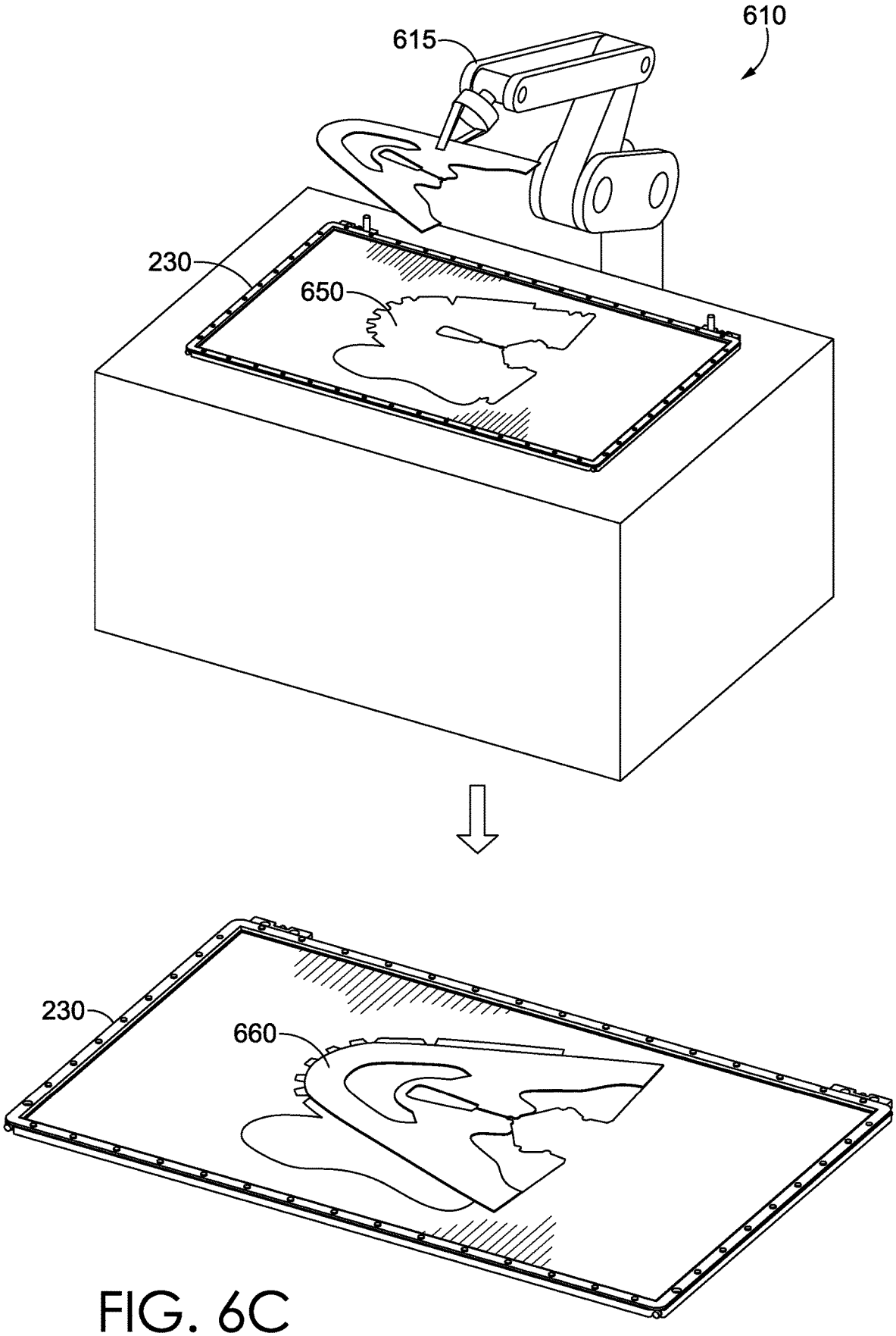
Figure 6D:
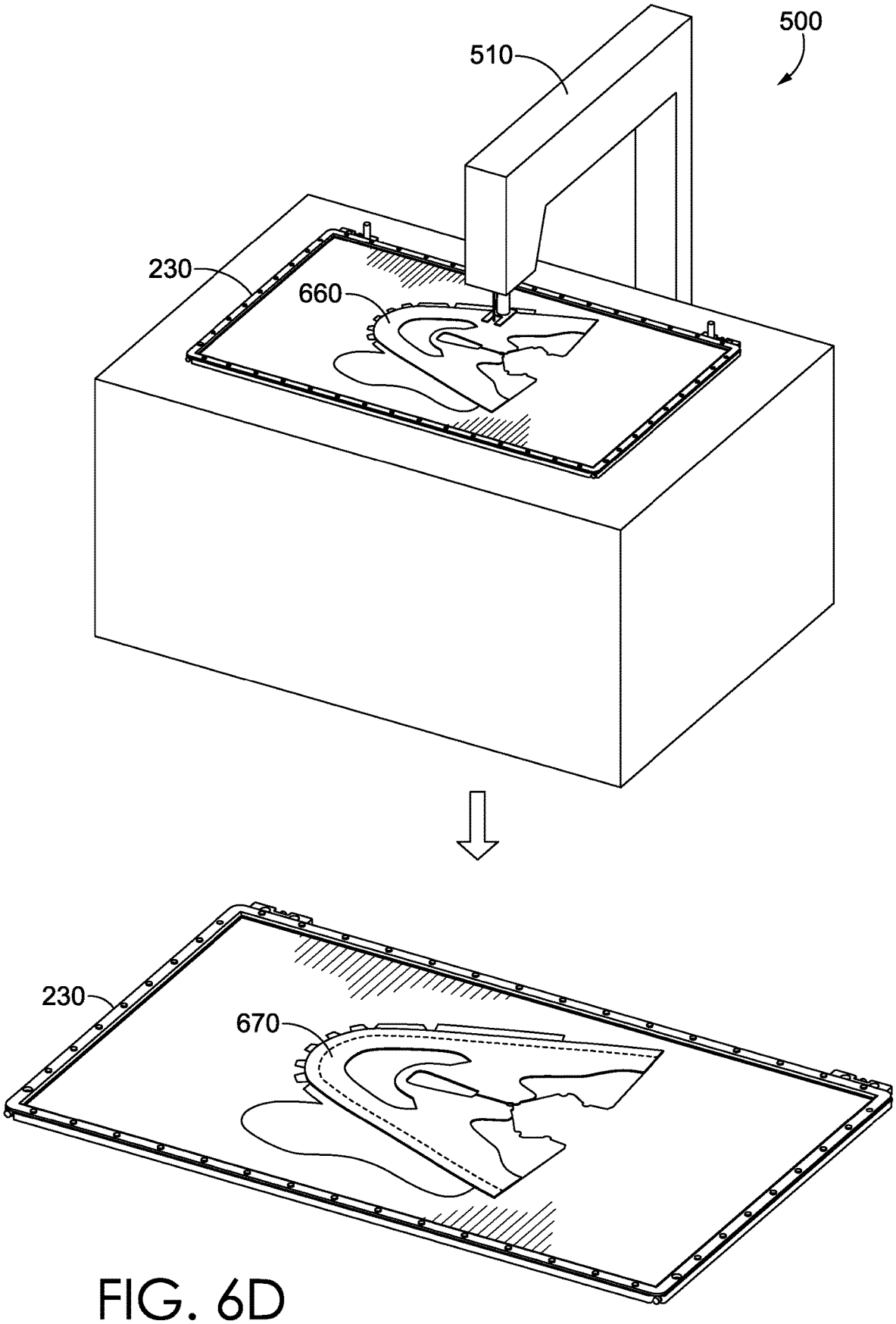

FIGS. 6A-E depict how frame 230 may be used in a series of manufacturing operations. Assembled frame 230 is engaged with a first manufacturing station 600. As shown in FIG. 6A, the first manufacturing station 600 comprises a rotary cutting tool 605. Also shown are a second manufacturing station 610 comprising placement arms 615 (FIG. 6C), and a third manufacturing station 500 comprising quilting arm 510 (FIG. 6D). The nature of the manufacturing operation at a particular manufacturing station, and the order in which the frame is delivered to various manufacturing stations, can be varied based on the product or product component being manufactured. Non-limiting examples of manufacturing operations include placement (e.g., deliberate repositioning of the materials, or the placement of new materials within the frame, possibly in addition to materials already in the frame), joining (needlework, adhesive application, thermal bonding, high frequency welding, ultrasonic welding, sonic welding, etc.), decoration (dying, dye sublimation, digital printing, pad printing, heat transfer, painting, spray painting, embellishing, needlework, etc.), dispensing (e.g., of adhesives or embellishments, like rhinestones or glitter), cutting, cleaning, tufting, texturizing, polishing, or the like. Different operations can be combined at a single manufacturing station. For example, a material may be joined and then cut-to-shape, or cut-to-shape and then serged, without being moved between physically separate manufacturing stations.

Frame 230 engages with manufacturing station 600 using alignment tabs 330 (shown in FIG. 6A extending from the same side of frame 230). The engagement with the alignment tabs confirms that the frame 230 is in a known and stable position at manufacturing station 600. Using data about the size of the frame, the materials involved, and any prior manufacturing operation(s), the manufacturing station can define an origin relative to the frame, or determine the position of the frame relative to an arbitrary origin, and proceed to perform location-specific processes without having to separately confirm the position of the material 205 inside the frame 230. That is, the position of a manufacturing operation can be precisely determined with visually or mechanically determining the position of the material 205.

Figure 6E:
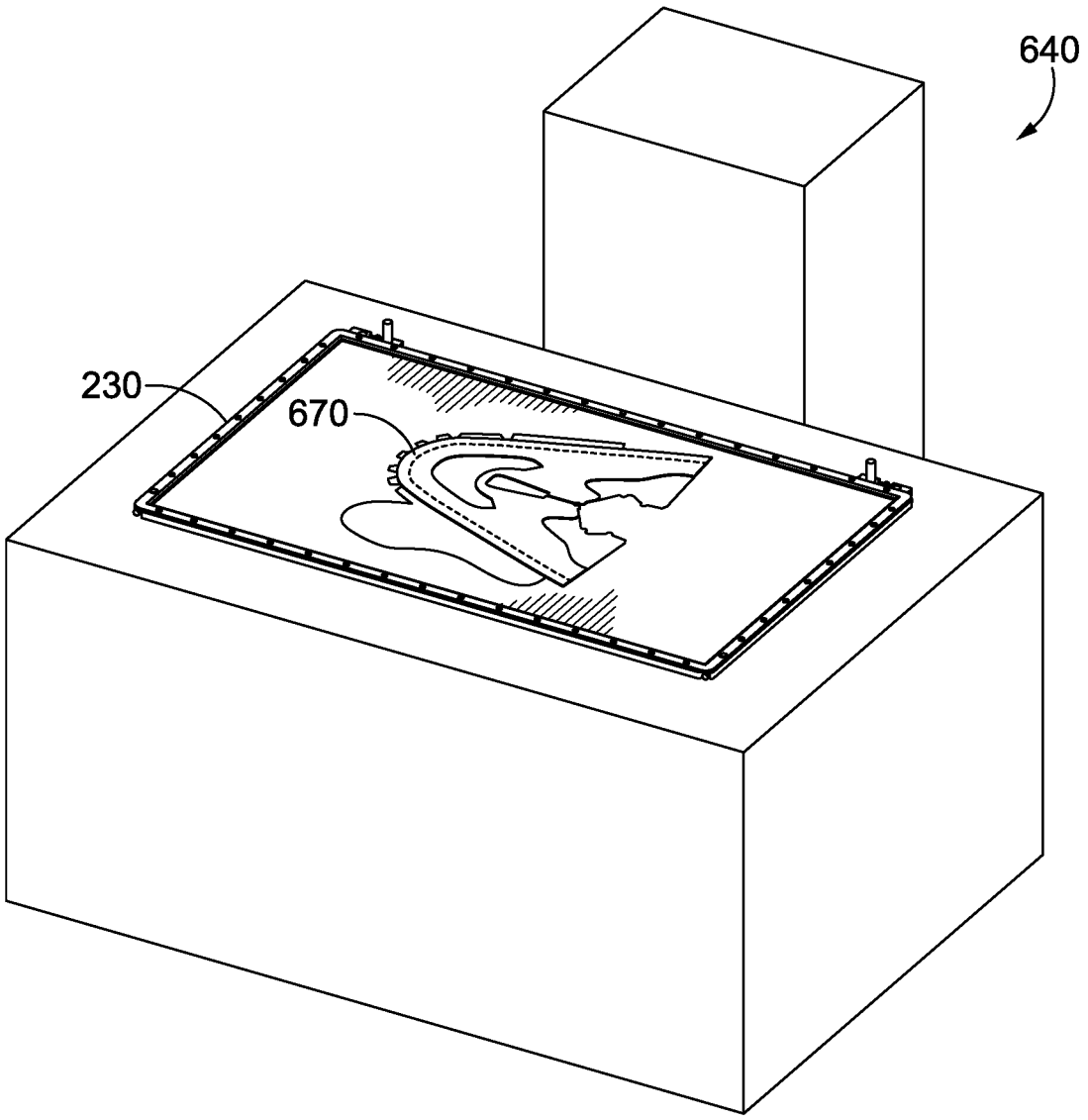

When the frame 230 is removed from manufacturing station 600, material 205 has been modified to in-process material 650, which in this case has been cut partially (e.g., scored) from material 205, as shown in FIG. 6B. Frame 230 with in-process material 650 may be transferred to a second manufacturing station 610, as shown in FIG. 6C. The alignment tab or tabs on frame 230 are then engaged with alignment elements at manufacturing station 610. As before, manufacturing station 610 can deduce the positon of in-process material 650 without direct, visual or mechanical confirmation. When the manufacturing operation at manufacturing station 610 is complete, manufacturing station 610 disengages the alignment tabs of frame 230, which now secures in-process material 660. Frame 230 is moved to manufacturing station 500, where manufacturing station 500 engages the alignment tab or tabs on frame 230, and performs a manufacturing operation, as shown in FIG. 6D. In this example, manufacturing station 500 provides needlework incorporating a layer added to in-process material 650 at manufacturing station 610, resulting in in-process material 670. When the manufacturing operation at manufacturing station 500 is complete, manufacturing station 500 disengages the alignment tab(s) of frame 230, which can then be used to transfer in-process material 670 to manufacturing station 640, as shown in FIG. 6E.

Manufacturing station 640 may comprise a further manufacturing operation. Manufacturing station 640 may comprise a removal and/or inspection station, where a completed product or product component is removed from frame 230, possibly by cutting a product or product component away from a portion of the original material 205. Alternately or additionally, manufacturing station 640 may comprise an assembly/disassembly machine to remove the product, product component, and/or non-product remnant materials. Manufacturing station 640 may represent a series of further manufacturing operations, in which each manufacturing station engages the alignment tabs on frame 230, performs a manufacturing operation, and disengages the alignment tabs.

Figure 7A:
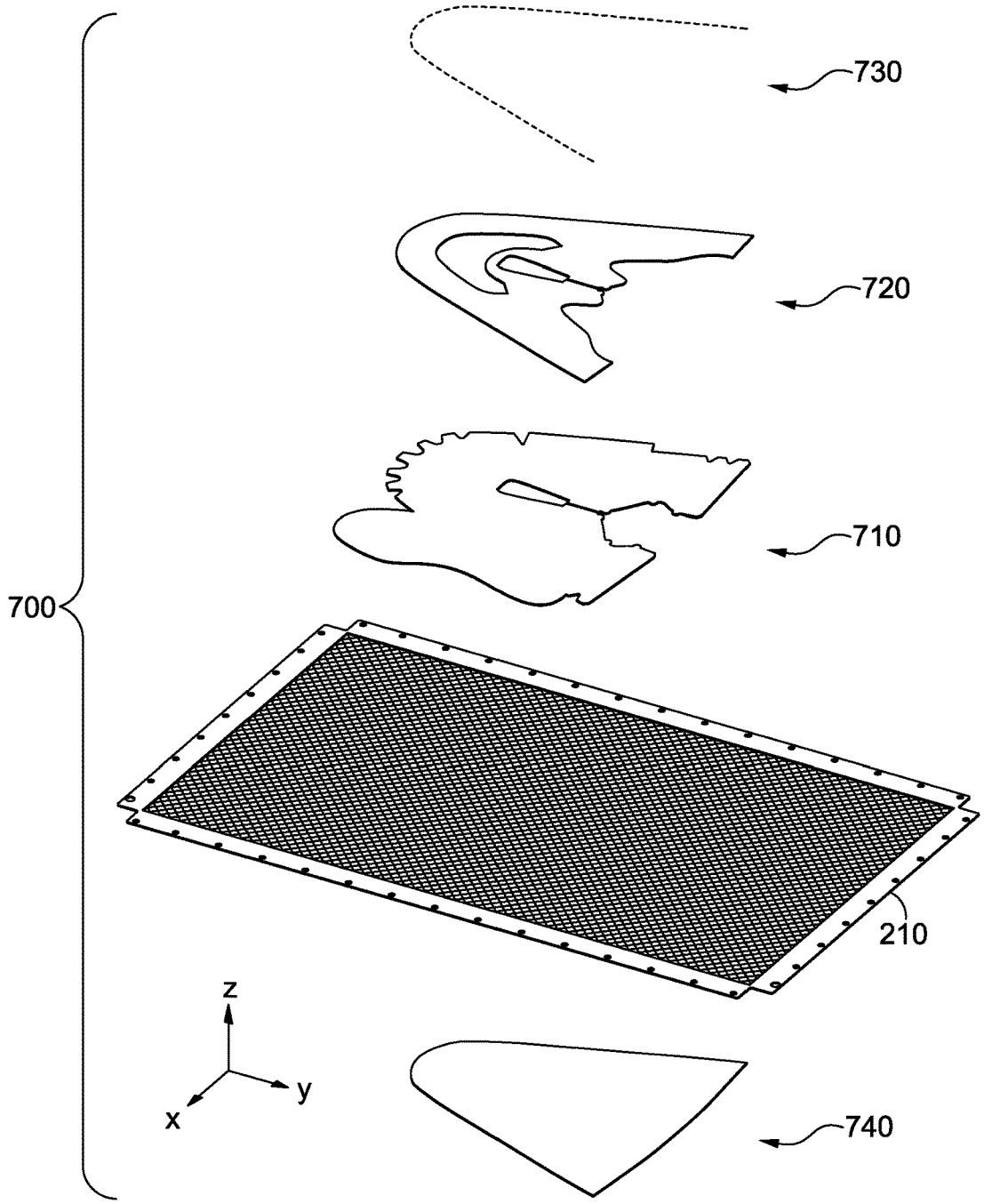
FIGS. 7A-B depict an exemplary stack of working materials in accordance with aspects of this disclosure.
Figure 7B:
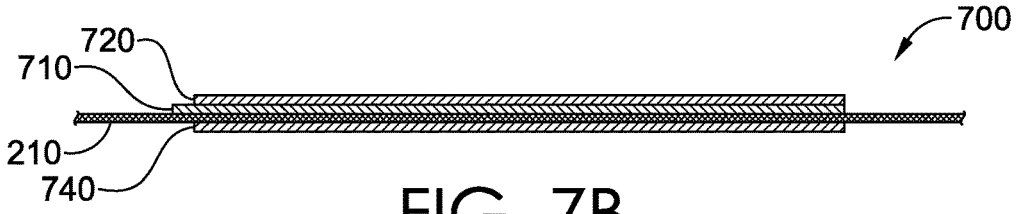

FIGS. 7A-B show how materials may stack up on a manufacturing frame. For example, a support structure 210 may be used. A first layer 710 may be pre-cut and placed or cut and placed at a first manufacturing station, as yielded in-process material 650. A second layer 720 may be placed at a second manufacturing station, as yielded in-process material 660. A needlework operation at a third manufacturing station may leave stitches 730, as yielded in-process material 670. As described below, manufacturing may occur on both faces of the frame 230 and material 205, making it possible to have a fourth layer 740 under support structure 210. In this particular example, support structure 210 may be removable, e.g., by tearing, dissolving, breaking, melting, or subliming support structure 210 when support structure 210 is no longer needed. Support structure 210 may be frangible, sacrificial or dissolvable. Support structure 210 could also have part lines, gaps, apertures, or the like that would allow the finished part or part component to be removed from the support structure 210. Layers 710, 720, 730 and 740 combine to form stack 700, as shown in FIG. 7B, which in this example was joined together by stitches 730.

Figure 8:
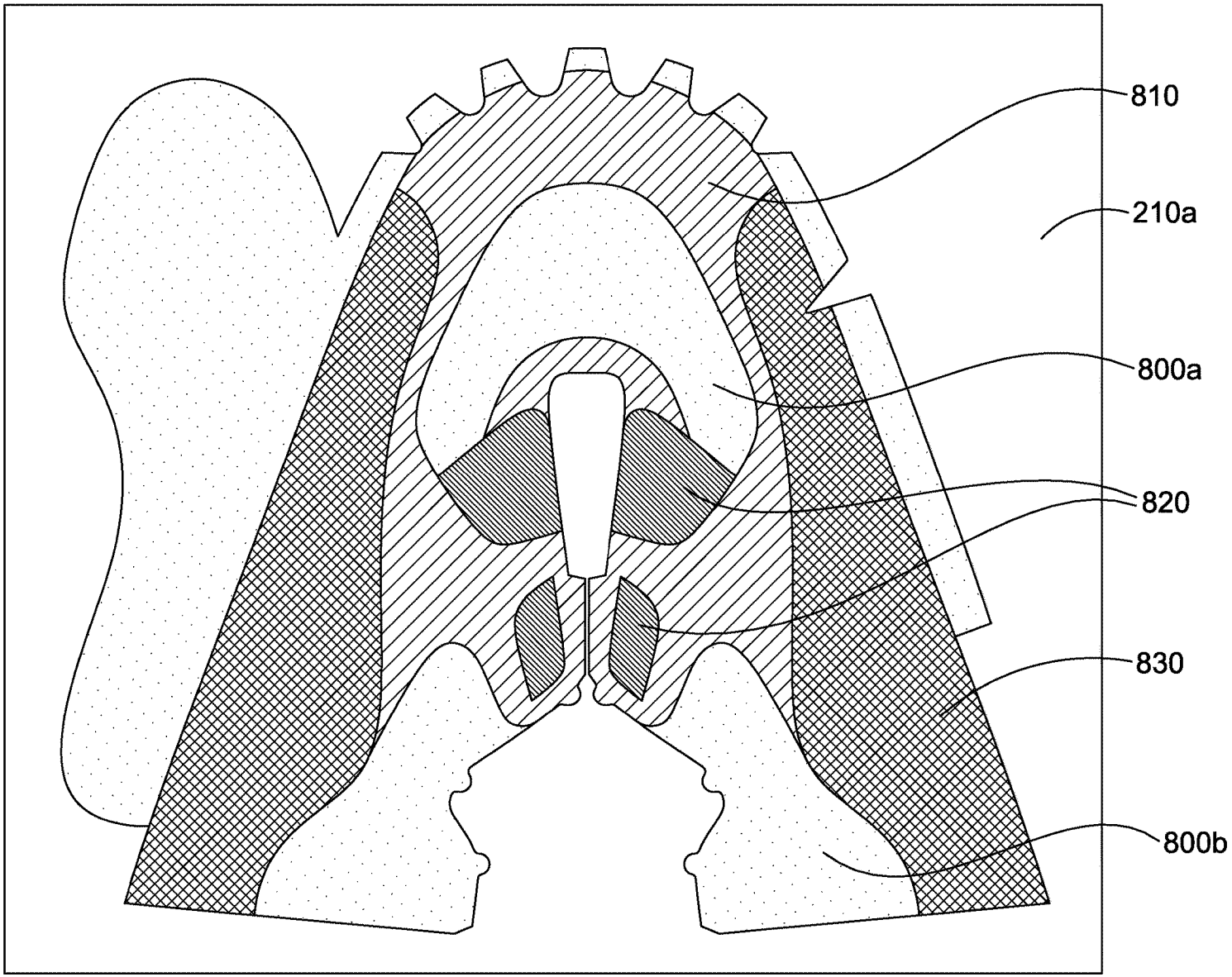
FIG. 8 depicts an exemplary stack of working materials in accordance with aspects of this disclosure.

FIG. 8 shows an exemplary stack of materials from a top view, where material 205 is the base material originally layered in the frame prior to manufacturing. As other layers are added, material 205 remains visible from the top of the stack in areas 800*a* and 800*b*. The stack may include a structural reinforcement layer 830, which shows through overlying layers near the center of the product. The stack may include a decorative layer 810, which adds color or visual variety to the design of the product. Layer 810 could also have structural features, such as stretch, or stretch resistance, or abrasion resistance, or tear resistance. As a result of the layering of complex shapes of distinct materials, an elaborate aesthetic appearance is created from just three layers of materials. Variations in the color or shape of any of the layers can make a significant change in the appearance of the product or product component, in this example, a shoe upper. And the layers can be positioned relative to one another during manufacture without direct visual confirmation or mechanical alignment using the location of the frame 230 as determined from one or more alignment tabs 330.

Figure 9:
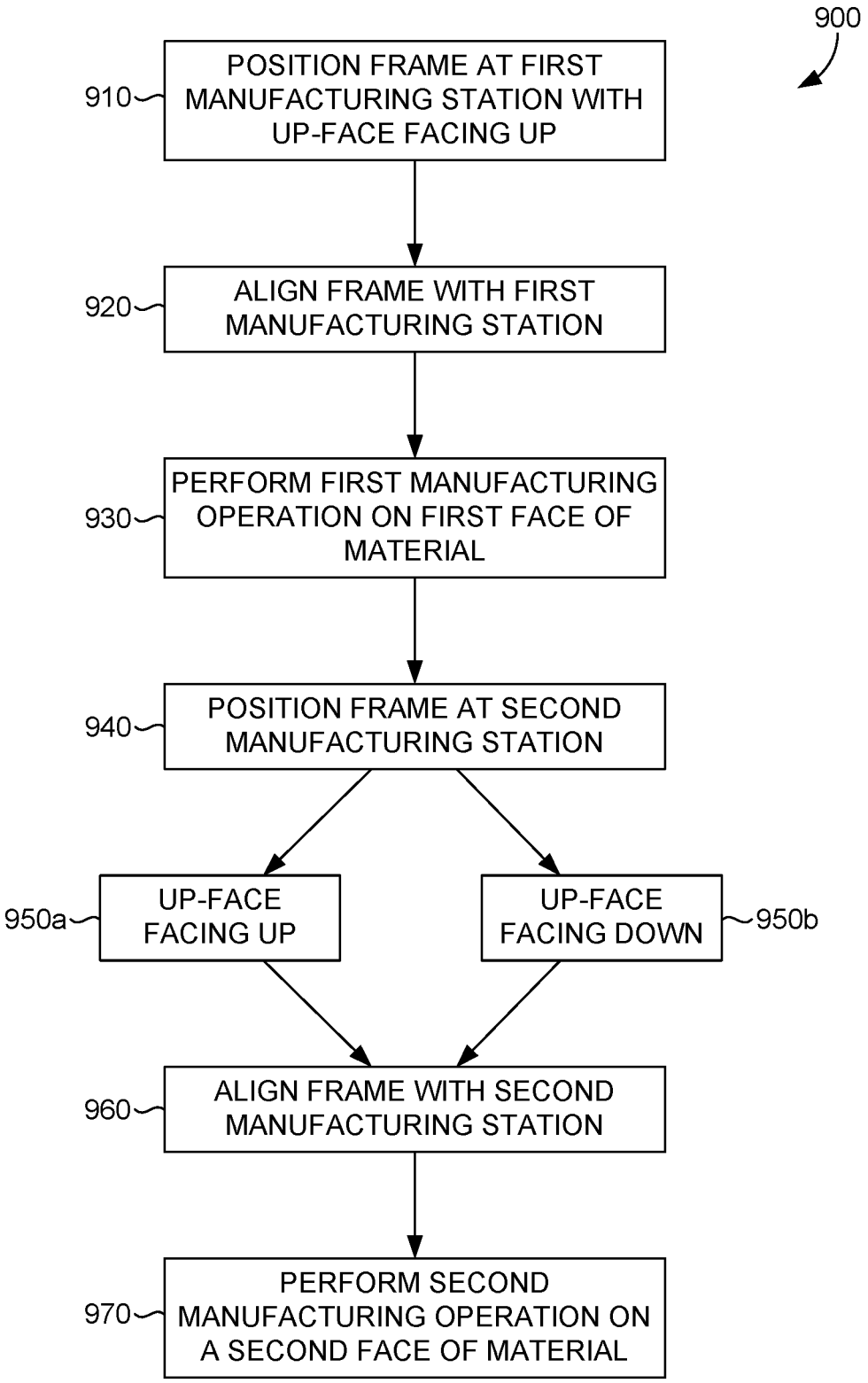
FIG. 9 depicts an exemplary flowchart for performing manufacturing operations on opposite faces of a material.
Figure 10A:
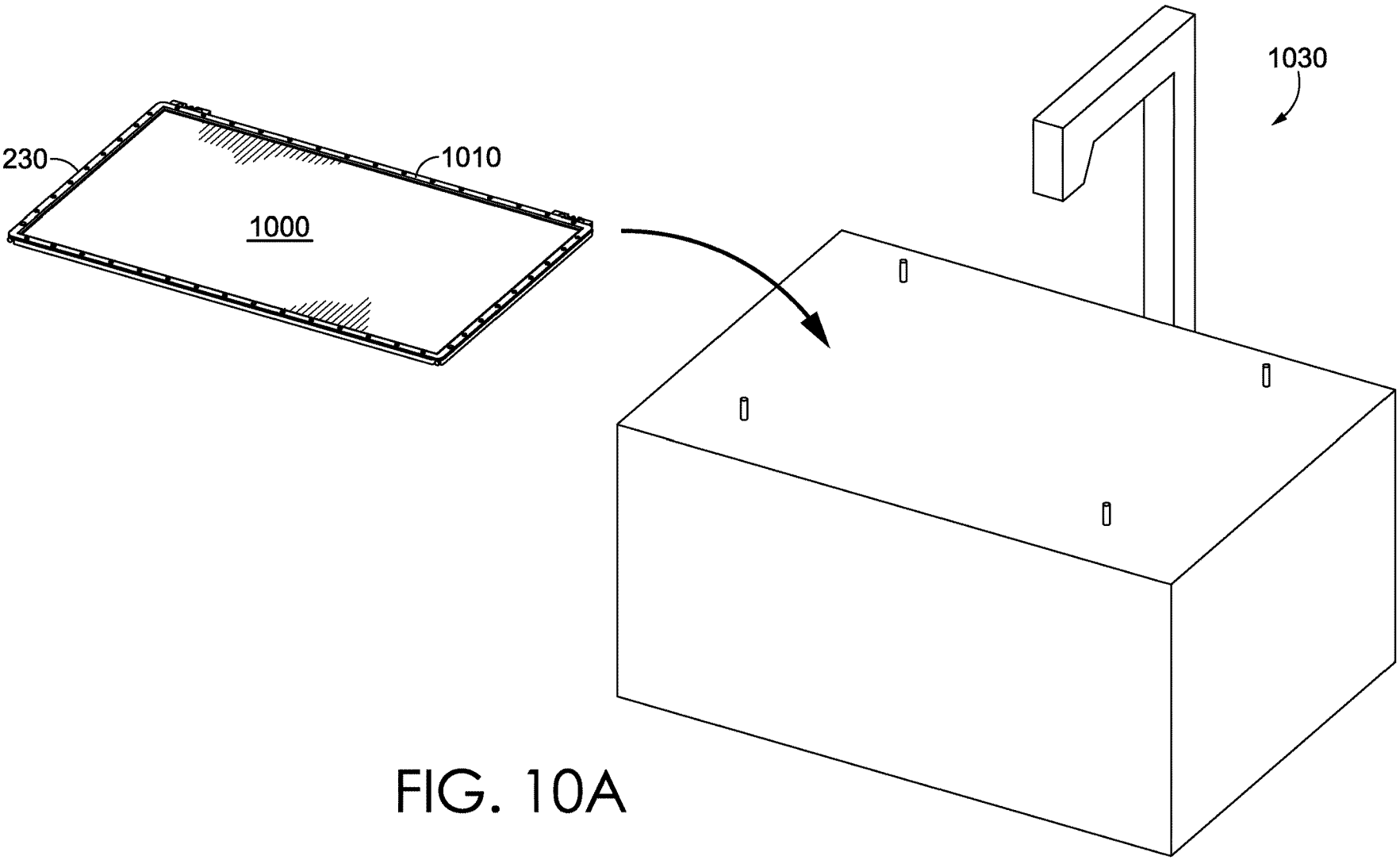
FIGS. 10A-D depict an exemplary series of manufacturing operations performed on opposite faces of a material.
Figure 10C:
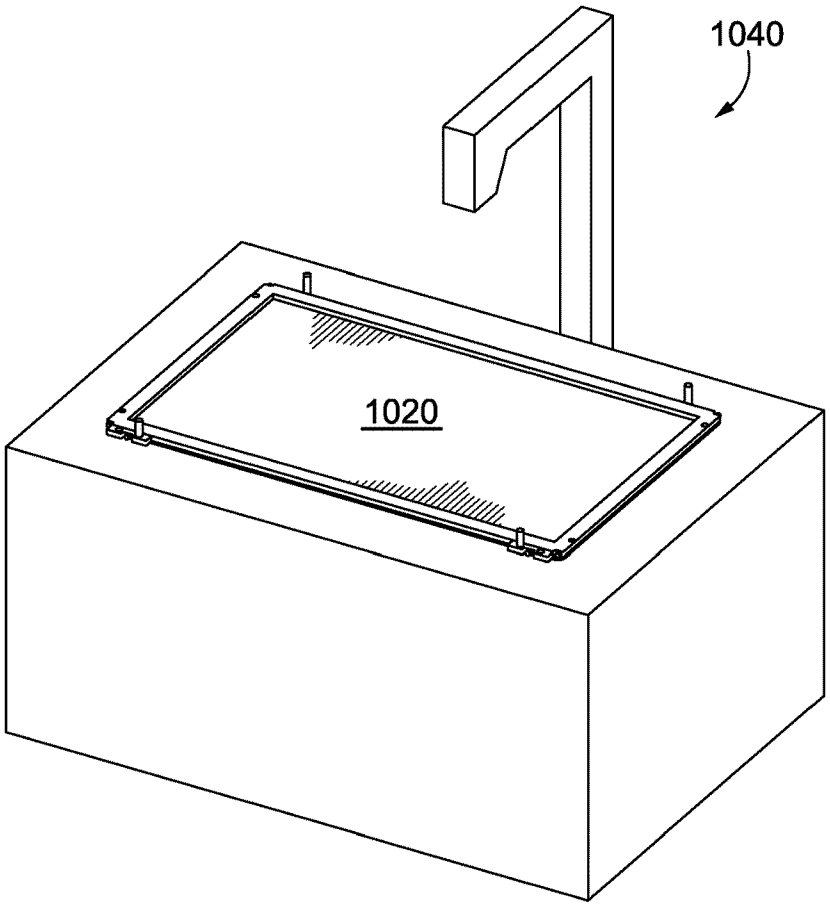
Figure 10B:
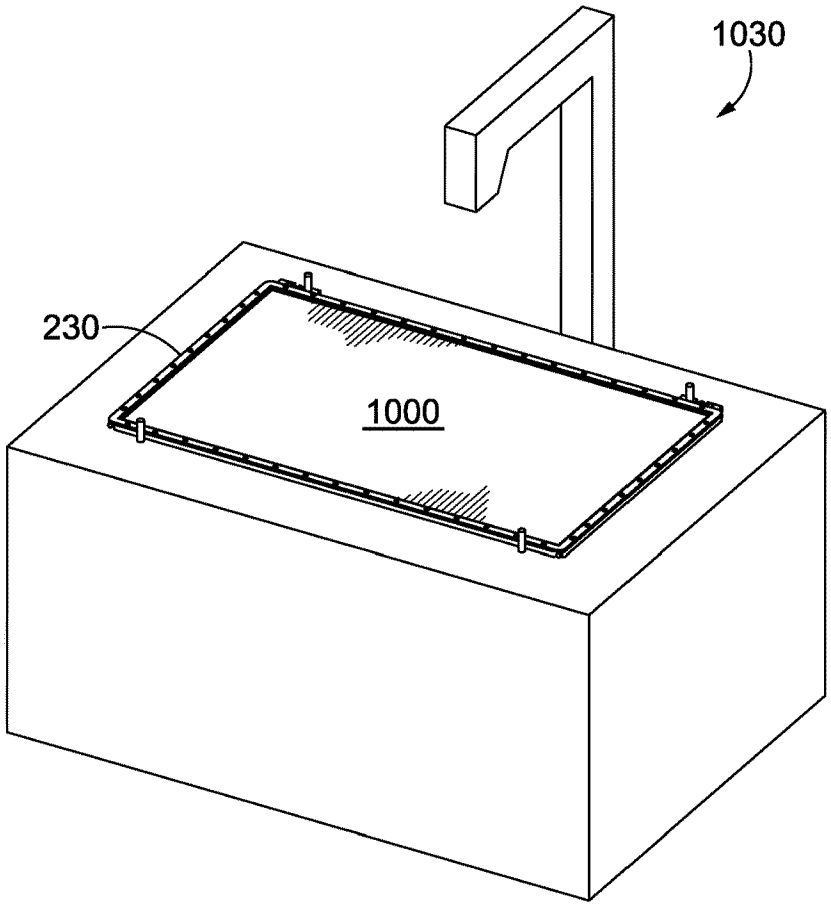

As mentioned above, a frame as described can facilitate manufacturing operations from both faces of the frame, or, stated differently, on both faces of a material 205 or support structure 210 secured within the frame 230. A process for manufacturing on both faces of a material is outlined in FIG. 9 and depicted in FIGS. 10A-D. At step 910, an assembled frame 230 is positioned at a first manufacturing station 1030. As shown, an up-face 1010 of the frame (and a corresponding up-face 1000 of the material 205 within the frame 230) faces up at the first manufacturing station 1030 (FIGS. 10A-B). In this sense, the face that the first manufacturing station operates upon may be the up-face, since the frame could just as easily be positioned at the first manufacturing station with the bottom frame 220 facing up or the top frame 200 facing up. The frame 230 is aligned with the first manufacturing station 1030 by engagement of the alignment tab(s) 330 on the frame 230 at step 920. A first manufacturing operation is performed on the first face of the material at step 930. While the first operation is performed on (or from) the first face of the material, it should be understood that the first operation may still contact or affect the second face of the material. For example, needlework may transcend both faces, and cutting through a material might also work both faces of the material. When the first manufacturing operation is complete, the manufacturing station disengages the alignment tab(s), and the frame can be removed from the first manufacturing station 1030.

Figure 10D:
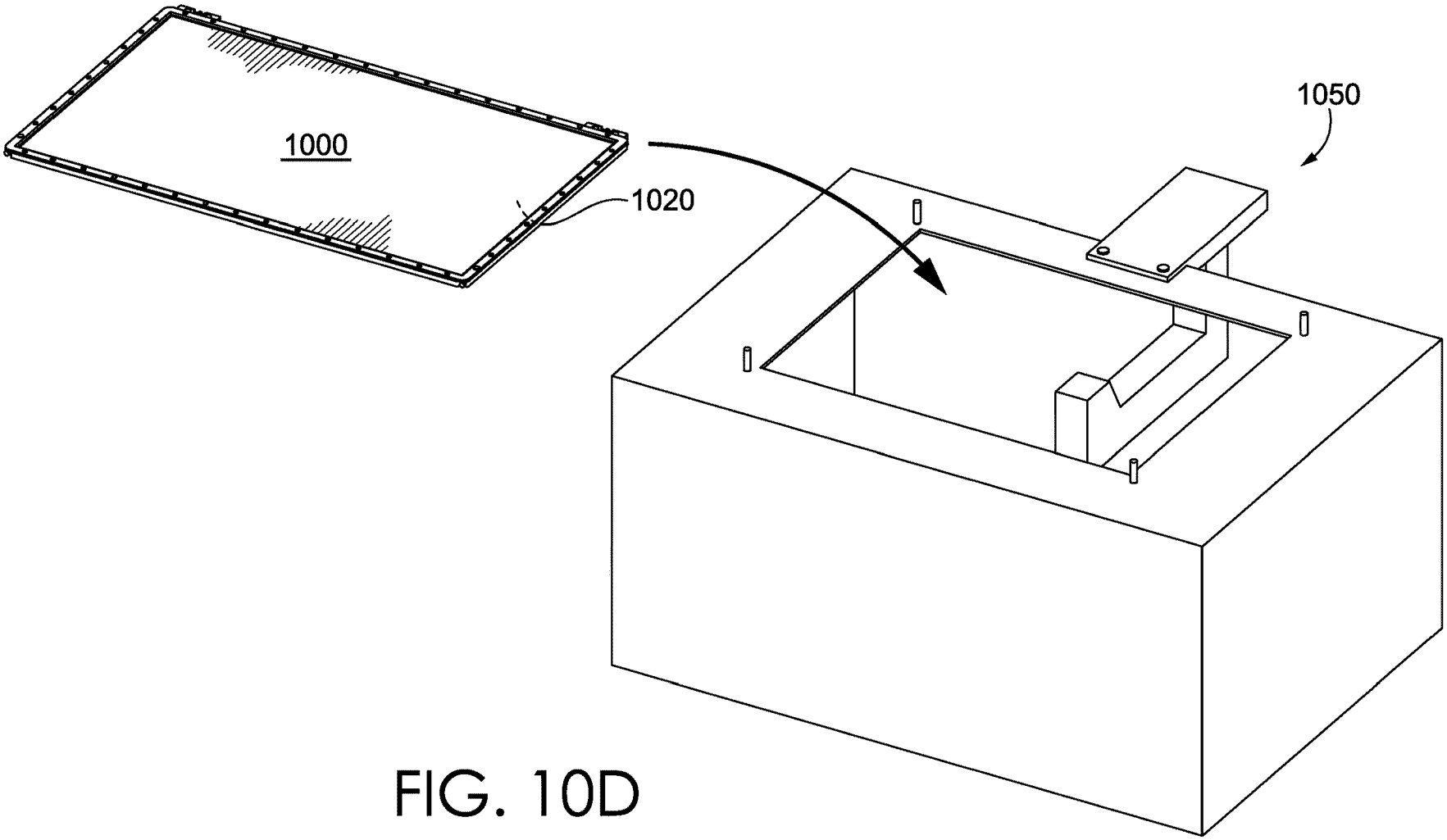

The frame 230 can be positioned at a second manufacturing station, shown as step 940. At the second manufacturing station, the frame 230 may be positioned with the up-face 1010 of the frame up 950*a* (FIG. 10D), or with the up-face 1010 down 950*b* (FIG. 10C). As at the first manufacturing station 1030, the frame 230 is aligned with the second manufacturing station by engagement of the alignment tab(s) 330 on the frame 230 at step 960. A second manufacturing operation is performed on the second face 1020 of the material at step 970. If the up-face 1000 is facing up, this may involve a manufacturing station 1050 configured to work from underneath the frame 230 (FIG. 10D). If the up-face 1000 is facing down, this may involve a manufacturing station 1040 configured to work on whatever surface is currently facing up (FIG. 10C). In either way, the second face 1020 or down-face of the material can be worked without removing the material 205 from the frame 230. The alignment tab(s) 330 on the frame 230 are disengaged, and the frame 230 can be removed from the second manufacturing station 1040 or 1050. Additional manufacturing operations can be performed on either face of the material, as desired. This may include adding layers to one or both faces, adding surface decoration or treatment (e.g., tufting, polishing, abraiding, adding glitter, painting or dying, etc.), or processes which affect both faces of the material from one face, such as cutting through the material(s) or some needlework operations.

It will be understood that certain features and subcombinations are of utility and may be employed without reference to other features and subcombinations. This is contemplated by and is within the scope of the claims.

Since many possible embodiments may be made within the scope of the invention, this description, including the accompanying drawings, is to be interpreted as illustrative and not in a limiting sense.

What is claimed is:

1. A frame for use in manufacturing having a long side and a short side, the frame comprising:

a perimeter defined by the long side, a second, opposing long side, the short side, and a second, opposing short side;

a gasket incorporated with the frame, wherein the gasket is compressible and capable of securing a material to the frame;

a first alignment tab extending from the frame long side, the first alignment tab comprising an alignment element, wherein the first alignment tab and the alignment element allow for positioning of the frame at a manufacturing station and defining an origin for a manufacturing process to occur within a center area defined by the perimeter; and an ejection pin that is capable of separating the frame from a second frame by pushing the frame away from the second frame, the second frame configured to coextensively mate with the frame.

2. The frame of claim 1, further comprising a second alignment tab, the second alignment tab comprising a second alignment element.

3. The frame of claim 2, wherein the second alignment tab extends from the frame long side, in an orientation the same as an orientation of the first alignment tab.

4. The frame of claim 3, wherein the first alignment tab is within 150 mm of the frame short side, and the second alignment tab is within 150 mm of the second, opposing short side.

5. The frame of claim 2, wherein the alignment element of the first alignment tab is positioned symmetrically about a center axis of the frame to the second alignment element.

6. The frame of claim 2, wherein the alignment element of the first alignment tab is positioned asymmetrically about a center axis of the frame to the second alignment element.

7. The frame of claim 1, wherein the alignment element protrudes from the first alignment tab.

8. The frame of claim 1, wherein the alignment element is a discontinuity in at least a surface of the first alignment tab.

9. The frame of claim 1, further comprising a tensioning element for securing the material within the frame.

10. The frame of claim 1, further comprising a support structure for supporting the material within the frame.

11. The frame of claim 10, wherein the support structure is discontinuous.

12. The frame of claim 1 further comprising a top frame and a bottom frame, wherein the gasket is incorporated with at least one of the top frame or the bottom frame.

13. The frame of claim 12, wherein the top frame comprises a bottom surface and the bottom frame comprises a top surface, wherein the gasket is incorporated with the top frame on the bottom surface or the bottom frame on the top surface.

14. The frame of claim 1, wherein the gasket is incorporated with the frame on at least one of a top surface or a bottom surface of a component forming the frame.

15. The frame of claim 1, wherein the frame further comprises a groove and the gasket is incorporated with the frame at the groove.

16. A frame for use in manufacturing, the frame comprising:

a first frame comprising:

(1) a first plurality of magnetic elements secured to the first frame;

(2) a first plurality of pins secured to the first frame, wherein the first plurality of pins are positioned around the first frame for securing a material extending across a center area of the first frame;

(3) a first aperture extending through the first frame;

a second frame configured to coextensively mate with the first frame, the second frame comprising:

(1) a second plurality of magnetic elements secured to the second frame, wherein the first plurality of magnetic elements and the second plurality of magnetic elements are cooperatively positioned to magnetically attract the first frame and the second frame in the coextensively mated configuration;

(2) a solid portion of the second frame configured to align with the first aperture of the first frame when in the coextensively mated configuration with the second frame; and an alignment tab extending from the frame when the second frame is coextensively mated with the first frame; and an ejection pin that separates the first frame from the second frame by pushing the first frame away from the second frame.

17. The frame of claim 16, wherein the frame is rectilinear.

18. The frame of claim 16, wherein the frame comprises aluminum or steel.

19. The frame of claim 16, wherein the first plurality of pins comprises at least 40 pins.

20. The frame of claim 16, wherein the first aperture does not extend through the second frame.

* * * * *